US007646363B2

(12) United States Patent
Yamashita et al.

(10) Patent No.: US 7,646,363 B2
(45) Date of Patent: Jan. 12, 2010

(54) DISPLAY DEVICE AND ELECTRONIC EQUIPMENT

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 331 days.

(21) Appl. No.: 11/890,491

(22) Filed: Aug. 7, 2007

(65) Prior Publication Data

US 2008/0042948 A1 Feb. 21, 2008

(30) Foreign Application Priority Data

Aug. 17, 2006 (JP) ..... 2006-222146

(51) Int. Cl.
*G09G 3/30* (2006.01)

(52) U.S. Cl. ..... 345/76; 345/82; 345/84; 345/92

(58) Field of Classification Search ..... 345/36, 345/38–39, 45, 76–78, 82–84, 87–88, 90–95, 345/98–100, 204–205, 210–214, 690; 315/169.1, 315/169.3

See application file for complete search history.

(56) References Cited

U.S. PATENT DOCUMENTS

| | | | | |
|---|---|---|---|---|
| 7,138,967 | B2 * | 11/2006 | Kimura | 345/76 |
| 7,187,351 | B2 * | 3/2007 | Kwon | 345/82 |
| 7,336,035 | B2 * | 2/2008 | Koyama | 315/169.3 |
| 7,414,599 | B2 * | 8/2008 | Chung et al. | 345/76 |
| 7,502,002 | B2 * | 3/2009 | Horiuchi et al. | 345/82 |
| 2006/0267509 | A1 * | 11/2006 | Yang | 315/169.3 |
| 2007/0085781 | A1 * | 4/2007 | Chung et al. | 345/76 |

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2005-309048 | 11/2005 |
| JP | 2005-345722 | 12/2005 |
| JP | 2006-133542 | 5/2006 |

OTHER PUBLICATIONS

Japanese Office Action issued on Jul. 9, 2008 for corresponding Japanese Application No. 2006-222146.

* cited by examiner

*Primary Examiner*—Richard Hjerpe
*Assistant Examiner*—Mansour M Said
(74) *Attorney, Agent, or Firm*—Rader, Fishman & Grauer PLLC

(57) ABSTRACT

A display device is disclosed. The display device includes: a pixel array part; and a drive part that drives the pixel array part. The pixel array part includes row-wise first scan lines and second scan lines, column-wise signal lines, pixels arranged in a matrix form on parts where the lines intersect, and power supply lines and ground lines that supply power to the respective pixels. The drive part includes a first scanner that sequentially supplies first control signals to the respective first scan lines and line-sequentially scans the pixels in units of rows, a second scanner that sequentially supplies second control signals to the respective second scan lines according to the line-sequential scan, and a signal selector that supplies video signals to the column-wise signal lines according to the line-sequential scan.

7 Claims, 27 Drawing Sheets

$$I_{ds} = k\mu\,(V_{gs} - V_{th})^2 = k\mu\,(V_{sig} - \Delta V)^2$$

DISPLAY DEVICE AND ELECTRONIC EQUIPMENT

CROSS REFERENCES TO RELATED APPLICATIONS

The present invention contains subject matter related to Japanese Patent Application JP 2006-222146 filed in the Japanese Patent Office on Aug. 17, 2006, the entire contents of which being incorporated herein by reference.

BACKGROUND OF THE INVENTION

1. Field of the Invention

The present invention relates to a display device that displays images by current-driving light emitting devices provided with respect to each pixel. Specifically, the invention relates to a so-called active matrix type-display device that controls amounts of current to be applied to light emitting devices such as organic EL devices with insulated gate field effect transistors provided within the respective pixel circuits. Further, the invention relates to electronic equipment in which such a display device is incorporated.

2. Background Art

In a display device such as a liquid crystal display, many liquid crystal pixels are arranged in a matrix form, and images are displayed by controlling transmittance intensity or reflectance intensity of incident light according to image information to be displayed with respect to each pixel. The same applies to an organic EL display using organic EL devices as pixels, however, the organic EL devices are self-luminous devices unlike the liquid crystal pixels. Accordingly, the organic EL display has advantages that the image visibility is higher, no backlight is necessary, and the response speed is faster in comparison to the liquid crystal display. Further, brightness levels (gradation) of the respective light emitting devices are controllable with amounts of current flowing therethrough, and the organic EL display is a so-called current control type device and largely different from voltage control type devices like the liquid crystal display.

In the organic EL display, there are drive systems of a simple matrix system and an active matrix system as is the case of the liquid crystal display. The former is simple in structure, however, it has problems in difficulty of realizing a large-scaled and high-definition display etc., and currently, the active matrix type system is increasingly developed. This system is to control the current flowing in the light emitting devices within the respective pixel circuits with active elements (generally, thin-film transistors, TFTs) provided within the pixel circuits, and disclosed in JP-A-2003-255856 (patent document 1), JP-A-2003-271095 (patent document 2), JP-A-2004-133240 (patent document 3), JP-A-2004-029791 (patent document 4), and JP-A-2004-093682 (patent document 5).

SUMMARY OF THE INVENTION

A pixel circuit in the past is provided in a part where a row-wise scan line that supplies a control signal and a column-wise signal line that supplies a video signal intersect, and includes at least a sampling transistor, a pixel capacity, a drive transistor, and a light emitting device. The sampling transistor conducts in response to the control signal supplied from the scan line and samples the video signal supplied from the signal line. The pixel capacity holds an input voltage according to the signal potential of the sampled video signal. The drive transistor supplies output current as drive current in a predetermined light emission time according to the input voltage held in the pixel capacity. Generally, the output current has a dependence on the carrier mobility and the threshold voltage of the channel region of the drive transistor. The light emitting device emits light in brightness with the output current supplied from the drive transistor according to the video signal.

The drive transistor receives at a gate the input voltage held in the pixel capacity and passes the output current between the source and drain to energize the light emitting device. Generally, the light emission brightness of the light emitting device is proportional to the amount of passing current. Further, the supply amount of output current of the drive transistor is controlled by the gate voltage, i.e., the input voltage written in the pixel capacity. In the pixel circuit in the past, the amount of current to be supplied to the light emitting device is controlled by changing the input voltage applied to the gate of the drive transistor in response to the input video signal.

Here, the operating characteristic of the drive transistor is expressed by the following equation 1.

$$Ids=(1/2)\mu(W/L)Cox(Vgs-Vth)2 \quad (1)$$

In the transistor characteristic equation 1, Ids represents the drain current flowing between the source and drain, and the output current supplied to the light emitting device in the pixel circuit. Vgs represents the gate voltage applied to the gate with reference to the source, and the above described input voltage in the pixel circuit. Vth is the threshold value of the transistor. Further, μ represents the mobility of a semiconductor thin film that configures the channel of the transistor. Furthermore, W represents the channel width, L represents the channel length, and Cox represents the gate capacity. As clearly found from the transistor characteristic equation 1, when the thin-film transistor operates in the saturated region, if the gate voltage Vgs becomes larger over the threshold voltage Vth, the transistor turns on and the drain current Ids flows. In principle, as expressed by the above transistor characteristic equation 1, when the gate voltage Vgs is constant, the drain current Ids in the same amount is constantly supplied to the light emitting device. Therefore, when video signals at the same level are supplied to all of the respective pixels forming the screen, it is supposed that all pixels emit light in the same brightness and the screen uniformity can be obtained.

However, actually, the independent thin-film transistor (TFT) including the semiconductor thin film of polysilicon or the like has variations in device characteristics. Especially, the threshold voltage Vth is not equal and varies with respect to each pixel. As clearly found from the transistor characteristic equation 1, if the threshold voltages Vth of the respective drive transistors vary, even when the gate voltages Vgs are constant, the drain currents Ids vary and brightness varies with respect to each pixel. Therefore, the screen uniformity is deteriorated. In the past, the pixel circuit incorporating the function of cancelling the variation in the threshold voltage Vth of the drive transistor has been developed, and disclosed in the patent document 3, for example.

However, the variation factor of the output current to the light emitting device is not only the threshold voltage Vth. As clearly found from the transistor characteristic equation 1, the output current Ids also varies when the mobility μ of the drive transistor varies. As a result, the screen uniformity is deteriorated. It is desirable that the variations in mobility are corrected.

According to an embodiment of the invention, there is provided a display device that incorporates a function of mobility correction of the drive transistor within independent pixels. Especially, according to the embodiment of the invention, variations in mobility correction time are suppressed, and thus, the screen uniformity of the display device is further improved. The display device according to the embodiment of the present invention basically includes a pixel array part and a drive part that drives the pixel array part. The pixel array part includes row-wise first scan lines and second scan lines, column-wise signal lines, pixels arranged in a matrix form on parts where the lines intersect, and power supply lines and ground lines that supply power to the respective pixels. The drive part includes a first scanner that sequentially supplies first control signals to the respective first scan lines and line-sequentially scans the pixels in units of rows, a second scanner that sequentially supplies second control signals to the respective second scan lines according to the line-sequential scan, and a signal selector that supplies video signals to the column-wise signal lines according to the line-sequential scan. The pixel includes a light emitting device, a sampling transistor, a drive transistor, a switching transistor, and a pixel capacity. The sampling transistor has a gate connecting to the first scan line, a source connecting to the signal line, and a drain connecting to a gate of the drive transistor. The drive transistor and the light emitting device are series-connected between the power supply line and the ground line to form a current path. The switching transistor is inserted into the current path and has a gate connecting to the second scan line. The pixel capacity connects between a source and the gate of the drive transistor. Here, the sampling transistor turns on in response to the first control signal supplied from the first scan line, and samples a signal potential of the video signal supplied from the signal line and holds the potential in the pixel capacity. The switching transistor turns on in response to the second control signal supplied from the second scan line to make the current path into a conducting state. The drive transistor passes a drive current to the light emitting device in response to the signal potential held in the pixel capacity through the current path in the conducting state. The drive part performs correction of mobility of the drive transistor on the signal potential held in the pixel capacity in a correction time from first timing when the second control signal is applied to the second scan line and the switching transistor turns on to second timing when the first control signal applied to the first scan line is cancelled and the sampling transistor turns off, after applying the first control signal to the first scan line and turning on the sampling transistor to start sampling of the signal potential. At least one of the first scanner and the second scanner has output buffers for outputting the first or second control signals. The output buffer has one switching element that principally forms a rising waveform of the control signal, and another switching element that principally forms a falling waveform of the control signal. The respective switching elements are configured by transistors, respectively. In the control signal, one of the rising waveform and the falling waveform is a determining waveform that determines the first timing or the second timing in the correction time, the other of the rising waveform and the falling waveform is a non-determining waveform that is unrelated to the first timing and the second timing in the correction time. In the output buffer, a transistor size of a superior switching element at the side of forming the determining waveform is set larger than a transistor size of an inferior switching element at the side of forming the non-determining waveform.

According to an embodiment, the output buffer is an inverter including a PMOS transistor and an NMOS transistor. When the falling waveform of the control signal is the determining waveform, the NMOS transistor that principally forms the waveform is the superior switching element, and, when the rising waveform of the control signal is the determining waveform, the PMOS transistor that principally forms the waveform is the superior switching element. The transistor size of the superior switching element is set larger than the transistor size of the inferior switching element. Preferably, both determining waveforms of the first timing and the second timing are falling waveforms, and the NMOS transistors are larger than the PMOS transistors in size in both output buffers of the first scanner and the second scanner. In another embodiment, in the output buffer, the superior switching element includes a CMOS transistor, the inferior switching element includes an NMOS transistor or PMOS transistor, and a size of the CMOS transistor is larger than a size of the NMOS transistor or PMOS transistor. In another embodiment, the output buffer draws a waveform of a pulse externally supplied and outputs the waveform as a determining waveform of the control signal when the superior switching element turns on and the inferior switching element turns off.

According to the embodiment of the invention, the correction of mobility of the drive transistor (mobility correction operation) is performed in the correction time from the first timing when the switching transistor turns on to the second timing when the sampling transistor turns off, after turning on the sampling transistor to start sampling of the signal potential. Specifically, the drive current flowing through the drive transistor in response to the signal potential is negatively fedback to the pixel capacity in the correction time and the signal potential held therein is adjusted. When the mobility of the drive transistor is larger, the amount of negative feedback is larger in response, the reduced amount of the signal potential increases, and thus, the drive current can be suppressed. On the other hand, when the mobility of the drive transistor is smaller, the amount of negative feedback to the pixel capacity is smaller and the reduced amount of the signal potential held therein is small. Therefore, the drive current is not reduced so much. In this manner, according to the magnitude of mobility of the drive transistors of the independent pixels, the signal potentials are adjusted to cancel the variations. Therefore, despite the variations in mobility of the drive transistors of the independent pixels, the independent pixels exhibit nearly the same levels of light emission brightness for the identical signal potential. Thus, the screen uniformity can be improved.

By the way, the amount of negative feedback to the pixel capacity is determined by the correction time. If the correction times are constant in all pixels, there are no variations in the amounts of negative feedback and the differences in mobility can be neatly corrected. However, actually, the pulses of the control signals supplied from the respective scanners to the sampling transistors and the switching transistors become dull due to the influence by wiring capacities and wiring resistances. The dullness of the pulse waveform causes shifts in the first timing when the switching transistor turns on and the second timing when the sampling transistor turns off, and the duration of the correction time varies. Accordingly, the embodiment of the invention designs the output buffers of the first scanner and the second scanner to make the waveforms of the control signals that determine the on-timing of the switching transistors and the off-timing of the sampling transistors steeper. Specifically, in the output buffer of the respective scanners, the transistor size of the superior switching element at the side of forming the determining waveform of the rising waveform and the falling waveform of the control signal pulse that determines the start and end of the mobility correction time is set larger than the transistor size of the inferior switching element at the side of forming the non-determining waveform. In this manner, by making the transistor size of the superior switching element larger, the current drive performance thereof is increased and the steepness of the determining waveform is made greater. The steeper determining waveform prevents variations in on-timing and off-timing of the transistors even when the threshold voltages of the sampling transistor and the switching transistor vary. Therefore, the embodiment of the invention can provide a display device capable of maintaining the mobility correction times at constant in respective pixels even when the threshold voltages of the transistors vary and advantageous in screen uniformity without brightness irregularities. Note that the transistor size in this specification indicates a size factor W/L. W is a channel width of the transistor and L is a channel length of the transistor. The wider the channel width W with reference to the channel length L (that is, the larger the size factor), the higher the current drive performance of the transistor. When the channel lengths L are the same, one having the wider channel width W naturally has the larger size factor. In this case, the status may be simply expressed by that the size is larger. When the channel lengths L are the same, the fact that the channel width W is larger means that the transistor size is larger.

DESCRIPTION OF PREFERRED EMBODIMENTS

Figure 1:
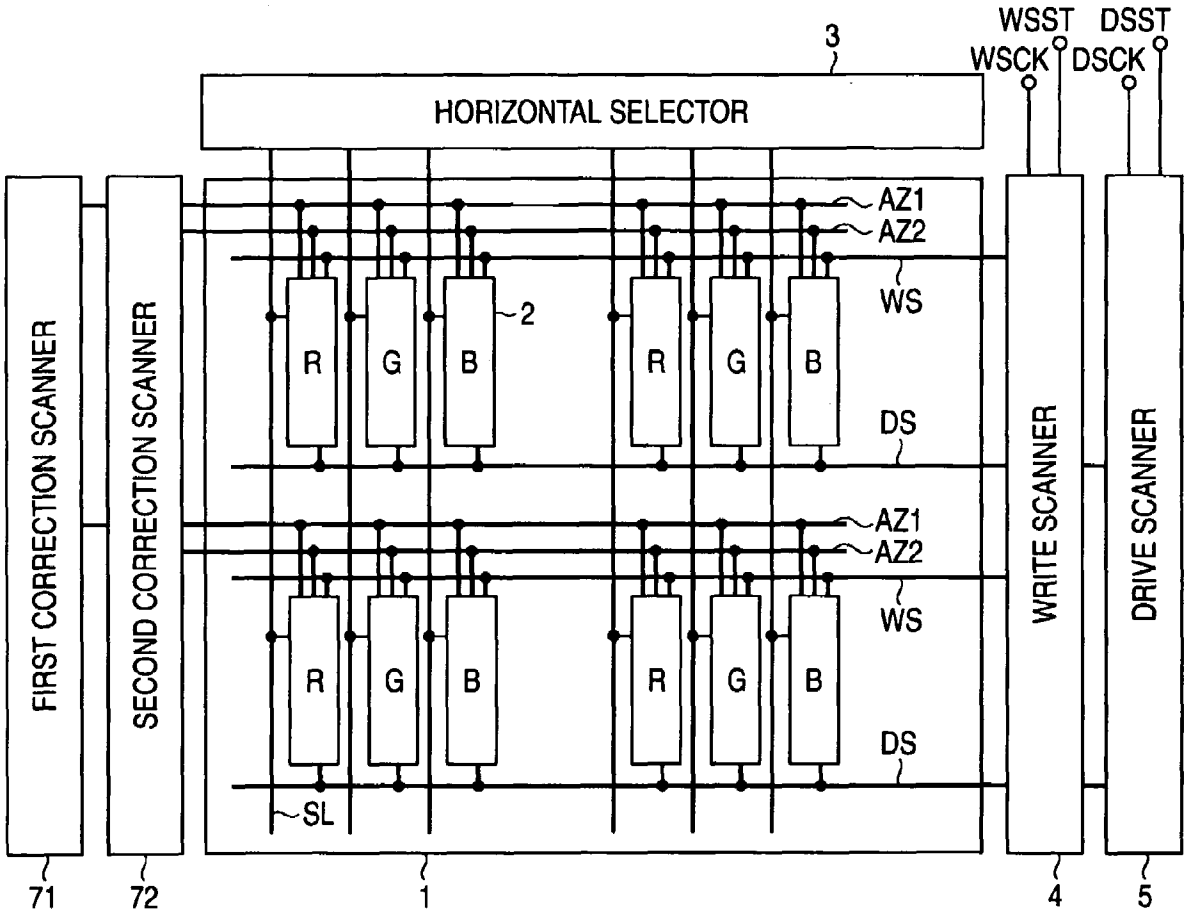
FIG. 1 is a block diagram showing an overall configuration of a display device according to an embodiment of the invention.

As below, embodiments of the present invention will be described in detail with reference to the drawings. FIG. 1 is a schematic block diagram showing an overall configuration of a display device according to an embodiment of the invention. As illustrated, the image display device is basically configured by a pixel array part 1 and a drive part including a scanner unit and a signal unit. The pixel array part 1 includes scan lines WS, scan lines AZ1, scan lines AZ2 and scan lines DS provided in a row-wise fashion, signal lines SL provided in a column-wise fashion, pixel circuits 2 in a matrix form connected to these scan lines WS, AZ1, AZ2, DS and the signal lines SL, and plural power supply lines that supply a first potential Vss1, a second potential Vss2 and a third potential VDD necessary for the operation of the respective pixel circuits 2. The signal unit includes a horizontal selector 3 and supplies video signals to the signal lines SL. The scanner unit includes a write scanner 4, a drive scanner 5, a first correction scanner 71 and a second correction scanner 72, and supplies control signals to the scan lines WS, the scan lines DS, the scan lines AZ1 and the scan lines AZ2, respectively, to sequentially scan the pixel circuits with respect to each row.

Here, the write scanner 4 is configured by a shift register, and operates in response to a clock signal WSCK externally supplied and sequentially transfers start signals WSST also externally supplied to output control signals WS to the respective scan lines WS. The drive scanner 5 is also configured by a shift register, and operates in response to a clock signal DSCK externally supplied and sequentially transfers start signals DSST also externally supplied to output control signals DS to the respective scan lines DS.

Figure 2:
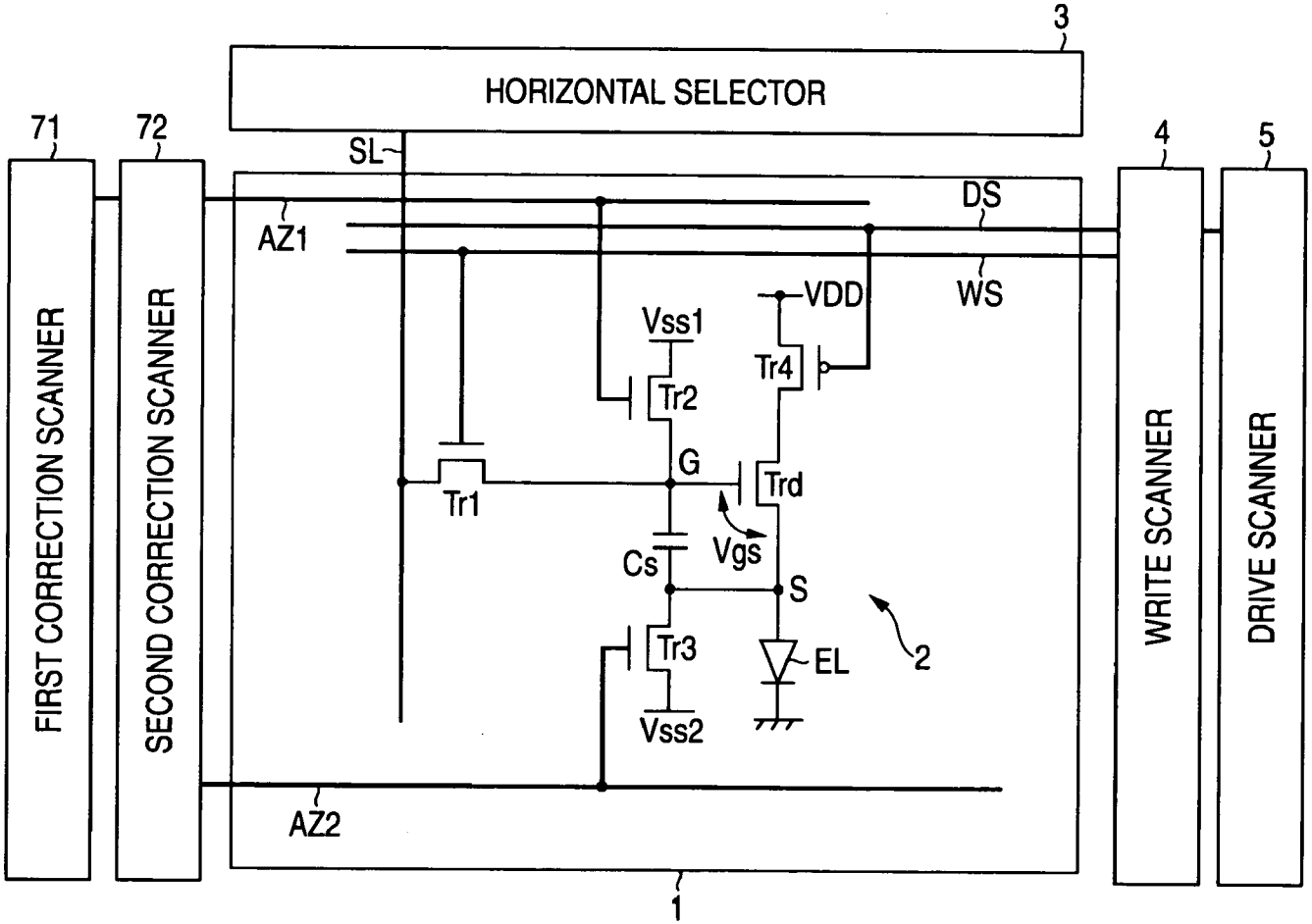
FIG. 2 is a circuit diagram showing a pixel configuration of the display device according to the embodiment of the invention.

FIG. 2 is a circuit diagram showing a configuration of a pixel incorporated in the image display device shown in FIG. 1. As illustrated, the pixel circuit 2 includes a sampling transistor Tr1, a drive transistor Trd, a first switching transistor Tr2, a second switching transistor Tr3, a third switching transistor Tr4, a pixel capacity Cs, and a light emitting device EL. The sampling transistor Tr1 conducts in response to the control signal supplied from the scan line WS and samples a signal potential of the video signal supplied from the signal line SL to the pixel capacity Cs in a predetermined sampling time. The pixel capacity Cs applies an input voltage Vgs to the gate G of the drive transistor Trd according to the signal potential of the sampled video signal. The drive transistor Trd supplies output current Ids according to the input voltage Vgs to the light emitting device EL. The light emitting device EL emits light in brightness according to the signal potential of the video signal with the output current Ids supplied from the drive transistor Trd in a predetermined light emission time.

The first switching transistor Tr2 conducts in response to the control signal supplied from the scan line AZ1 and sets the gate G of the drive transistor Trd to the first potential Vss1 prior to the sampling time. The second switching transistor Tr3 conducts in response to the control signal supplied from the scan line AZ2 and sets the source S of the drive transistor Trd to the second potential Vss2 prior to the sampling time. The third switching transistor Tr4 conducts in response to the control signal supplied from the scan line DS, connects the drive transistor Trd to the third potential VDD prior to the sampling time, and thus, corrects the influence of a threshold voltage Vth by allowing the pixel capacity Cs to hold a voltage corresponding to the threshold voltage Vth of the drive transistor Trd. Further, the third switching transistor Tr4 conducts in response to the control signal supplied from the scan line DS again in the light emission time, connects the drive transistor Trd to the third potential VDD, and passes the output current Ids through the light emitting device EL.

As clearly understood from the above description, the pixel circuit 2 is configured by five transistors Tr1 to Tr4 and Trd, one pixel capacity Cs, and one light emitting device EL. The transistors Tr1 to Tr3 and Trd are N-channel polysilicon TFTs. Only the transistor Tr4 is a P-channel polysilicon TFT. Note that the invention is not limited to the configuration but also N-channel and P-channel TFTs may be appropriately mixed. The light emitting device EL is a diode-type organic EL device with an anode and a cathode, for example. Also note that the invention is not limited to the configuration but also the light emitting device includes all devices that generally emit light by current driving.

As a feature of the embodiment of the invention, the drive part of the display device applies the first control signal WS to the first scan line WS to turn on the sampling transistor Tr1 and start the sampling of the signal potential, then, performs correction of the mobility μ of the drive transistor Trd on the signal potential held in the pixel capacity Cs, and thus, performs mobility correction in a correction time t from the first timing when the second control signal DS is applied to the second scan line DS and the switching transistor Tr4 is turned on to the second timing when the first control signal WS applied to the first scan line WS is cancelled and the sampling transistor Tr1 is turned off.

Figure 3:
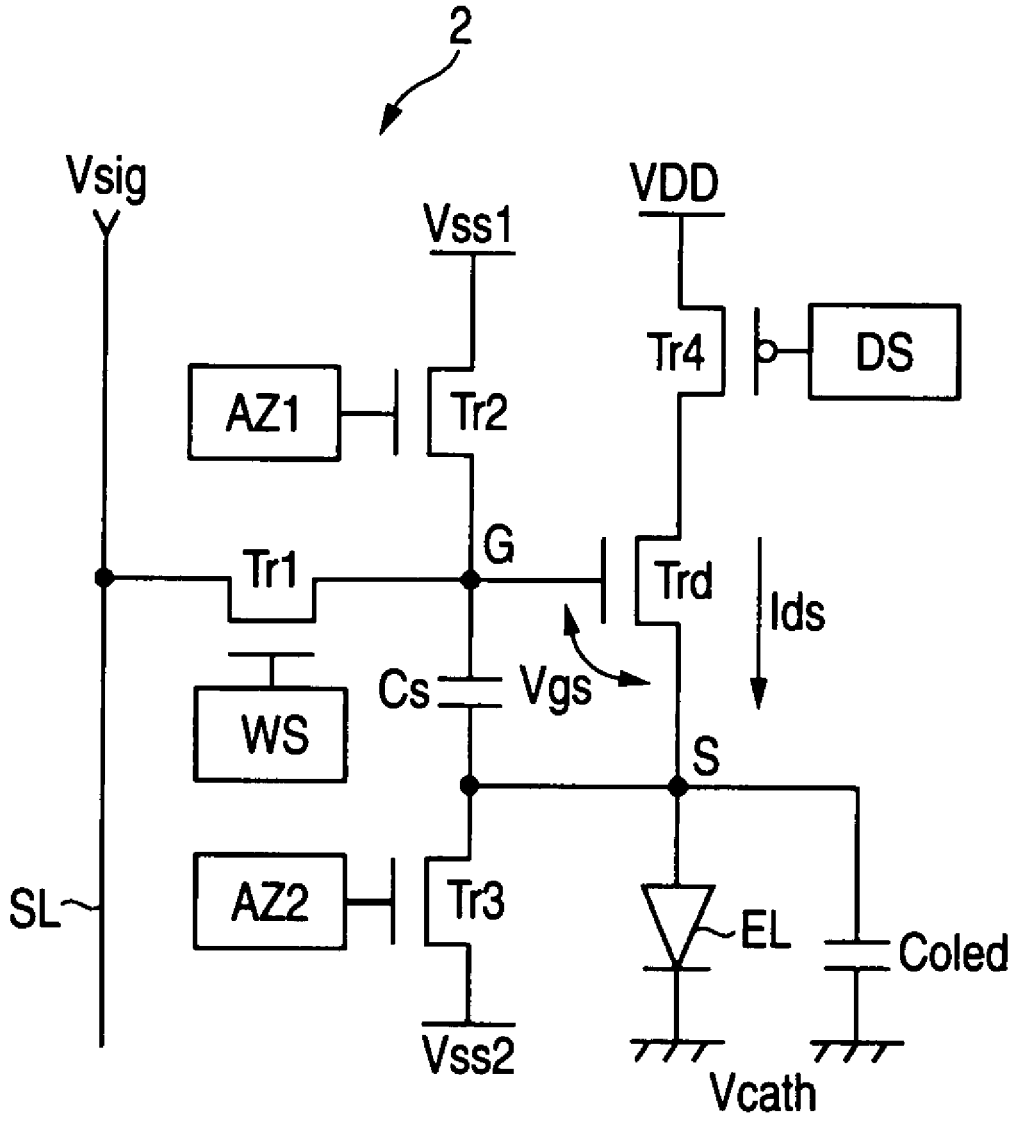
FIG. 3 is a circuit diagram for explanation of an operation of the display device according to the embodiment of the invention.

FIG. 3 is a schematic diagram showing only the part of the pixel circuit 2 taken from the image display device shown in FIG. 2. For easy understanding, the signal potential Vsig of the video signal sampled by the sampling transistor Tr1, the input voltage Vgs and the output current Ids of the drive transistor Trd, and further, the capacity component Coled that the light emitting device EL has are added thereto. As below, an operation of the pixel circuit 2 according to the embodiment of the invention will be described with reference to FIG. 3.

Figure 4:
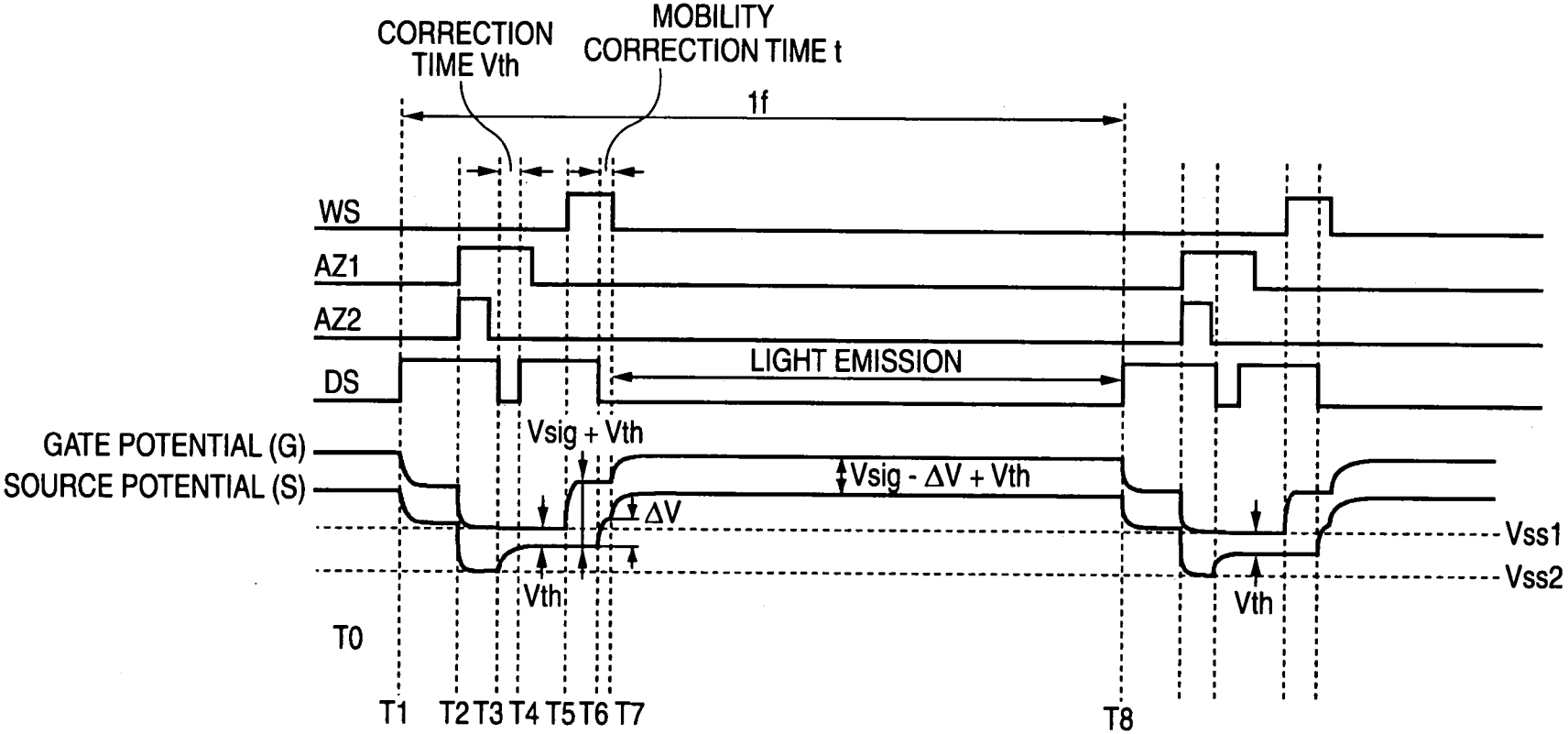
FIG. 4 is a timing chart for explanation of the operation of the display device.

FIG. 4 is a timing chart of the pixel circuit shown in FIG. 3. The operation of the pixel circuit shown in FIG. 3 will be specifically described with reference to FIG. 4. FIG. 4 shows waveforms of control signals applied to the respective scan lines WS, AZ1, AZ2 and DS along the time axis T. For simplification of notation, the control signals are expressed by the same signs as the signs of the corresponding scan lines. Since the transistors Tr1, Tr2, Tr3 are N-channel transistors, they turn on when the scan lines WS, AZ1, AZ2 are at the high level and turn off when the scan lines are at the low level, respectively. On the other hand, since the transistor Tr4 is a P-channel transistor, it turns off when the scan line DS is at the high level and turns on when the scan line is at the low level. The timing chart shows the potential change of the gate G and the potential change of the source S of the drive transistor Trd in addition to the waveforms of the respective control signals WS, AZ1, AZ2, DS.

In the timing chart shown in FIG. 4, timings T1 to T8 are set as one field (1f). The respective rows of the pixel array are sequentially scanned once during one field. The timing chart shows waveforms of the respective control signals WS, AZ1, AZ2, DS applied to pixels of one row.

At timing T0 before the field starts, all of the control signals WS, AZ1, AZ2, DS are at the low level. Accordingly, the N-channel transistors Tr1, Tr2, Tr3 are in the off-state, while only the P-channel transistor Tr4 is in the on-state. Since the drive transistor Trd is connected to the power supply VDD via the on-state transistor Tr4, the transistor Trd supplies the output current Ids to the light emitting device EL according to the predetermined input voltage Vgs. Therefore, the light emitting device EL emits light at the timing T0. In this regard, the input voltage Vgs applied to the drive transistor Trd is expressed by the difference between the gate potential (G) and the source potential (S).

At the timing T1 when the field starts, the control signal DS switches from the low level to the high level. Thereby, the switching transistor Tr4 turns off and the drive transistor Trd is disconnected from the power supply VDD, and thus, the light emission is stopped and the non-light emission time is started. Therefore, at the timing T1, all of the transistors Tr1 to Tr4 turn off.

Subsequently, at the next timing T2, the control signals AZ1 and AZ2 reach the high level, the switching transistors Tr2 and Tr3 turn on. Consequently, the gate G of the drive transistor Trd connects to the reference potential Vss1 and the source S is connected to the reference potential Vss2. Here, Vss1−Vss2>Vth is satisfied, and the Vth correction to be performed at the next timing T3 is prepared by setting Vss1−Vss2=Vgs>Vth. In other words, the time T2-T3 corresponds to a reset time of the drive transistor Trd. Further, given that the threshold voltage of the light emitting device EL is VthEL, VthEL>Vss2 is set. Thereby, a negative bias is applied to the light emitting device EL, and so-called in the reverse bias-state. The reverse bias-state is necessary for normally performing the following Vth correction operation and mobility correction operation.

At the timing T3, the control signal AZ2 is switched to the low level, and immediately, the control signal DS is also switched to the low level. Thereby, the transistor Tr3 turns off and the transistor Tr4 turns on. Consequently, the drain current Ids flows into the pixel capacity Cs, and the Vth correction operation is started. In this regard, the gate G of the drive transistor Trd is held at Vss1, and the current Ids flows until the drive transistor Trd cuts off. After cutting off, the source potential (S) of the drive transistor Trd becomes Vss1−Vth. At the timing T4 after the drain current cuts off, the control signal DS is returned to the high level and the switching transistor Tr4 is turned off. Similarly, the control signal AZ1 is returned to the low level and the switching transistor Tr2 is turned off.

Consequently, Vth is held and fixed in the pixel capacity Cs. As described above, the timing T3-T4 is a time for detecting the threshold voltage Vth of the drive transistor Trd. Here, the detection time T3-T4 is called a Vth correction time.

After the Vth correction is performed as described above, at the timing T5, the control signal WS is switched to the high level, the sampling transistor Tr1 is turned on, and the video signal Vsig is written in the pixel capacity Cs. The pixel capacity Cs is sufficiently small compared to the equivalent capacity Coled of the light emitting device EL. Consequently, most of the video signal Vsig is written in the pixel capacity Cs. To be precise, the difference of Vsig relative to Vss1, Vsig−Vss1 is written in the pixel capacity Cs. Therefore, the voltage Vgs between the gate G and the source S of the drive transistor Trd reaches a level of the sum of Vth that has been previously detected and held and Vsig−Vss1 sampled at this time, (Vsig−Vss1+Vth). Given that Vss1=0V to make the following description easier, the voltage Vgs between gate and source is Vsig+Vth as shown in the timing chart of FIG. 4. Sampling of the video signal Vsig is performed until the timing T7 when the control signal WS returns to the low level. That is, the timing T5-T7 corresponds to a sampling time.

At the timing T6 before the timing T7 when the sampling time ends, the control signal DS reaches the low level and the switching transistor Tr4 turns on. Thereby, the drive transistor Trd is connected to the power supply VDD, and the pixel circuit moves from the non-light emission time to the light emission time. In this manner, in the time T6-T7 in which the sampling transistor Tr1 remains in the on-state and the switching transistor Tr4 enters the on-state, the mobility correction of the drive transistor Trd is performed. That is, in the embodiment of the invention, mobility correction is performed in the time T6-T7 in which the posterior part of the sampling time and the head part of the light emission time overlap. Note that, in the head part of the light emission time in which the mobility correction is performed, the light emitting device EL is actually in the reverse bias-state and emits no light. In the mobility correction time T6-T7, the drain current Ids flows through the drive transistor Trd while the gate G of the drive transistor Trd is fixed at the level of the video signal Vsig. Here, by setting Vss1−Vth<VthEL, the light emitting device EL is made in the reverse bias-state, and thereby, exhibits not a diode characteristic but a simple capacity characteristic. Thus, the current Ids flowing through the drive transistor Trd is written in a capacity formed by coupling the pixel capacity Cs and the equivalent capacity Coled of the light emitting device EL, C=Cs+Coled. Thereby, the source potential (S) of the drive transistor Trd rises.

In the timing chart of FIG. 4, the amount of rising is expressed by ΔV. The amount of rising ΔV is eventually subtracted from the gate/source voltage Vgs held in the pixel capacity Cs, and negatively fedback. In this manner, the mobility μ can be corrected by negatively feedbacking the output current Ids of the drive transistor Trd to the input voltage Vgs of the same drive transistor Trd. The amount of negative feedback ΔV can be optimized by adjusting the duration t of the mobility correction time T6-T7.

At the timing T7, the control signal WS reaches the low level and the sampling transistor Tr1 turns off. Consequently, the gate G of the drive transistor Trd is disconnected from the signal line SL. Since the application of the video signal Vsig is cancelled, the gate potential (G) of the drive transistor Trd becomes risable and rises together with the source potential (S). In the meantime, the gate/source voltage Vgs held in the pixel capacity Cs maintains the value (Vsig−ΔV+Vth). With the rise of the source potential (S), the reverse bias-state of the light emitting device EL is cancelled and the light emitting device EL actually starts to emit light by the inflow of the output current Ids. The relationship between the drain current Ids and the gate voltage Vgs in this regard is given as in the following equation 2 by substituting Vsig−ΔV+Vth into Vgs of the above transistor characteristic equation 1.

$$Ids=k\mu(Vgs-Vth)2=k\mu(Vsig-\Delta V)2 \quad (2)$$

In the equation 2, k=(½) (W/L)Cox. From the canceling of the term Vth from the characteristic equation 2, it is known that the output current Ids supplied to the light emitting device EL does not depend on the threshold voltage Vth of the drive transistor Trd. Basically, the drain current Ids is determined by the signal voltage Vsig of the video signal. In other words, the light emitting device EL emits light in brightness according to the video signal Vsig. In this regard, Vsig has been corrected with the amount of negative feedback ΔV. The amount of correction ΔV serves to counteract the effect of the mobility μ just located in the coefficient part of the characteristic equation 2. Therefore, the drain current Ids substantially depends only on the video signal Vsig.

Finally, at timing T8, the control signal DS reaches the high level and the switching transistor Tr4 turns off, and the light emission ends and the field ends. Then, the operation moves to the next field and the Vth correction operation, mobility correction operation and light emission operation are repeated.

Figure 5:
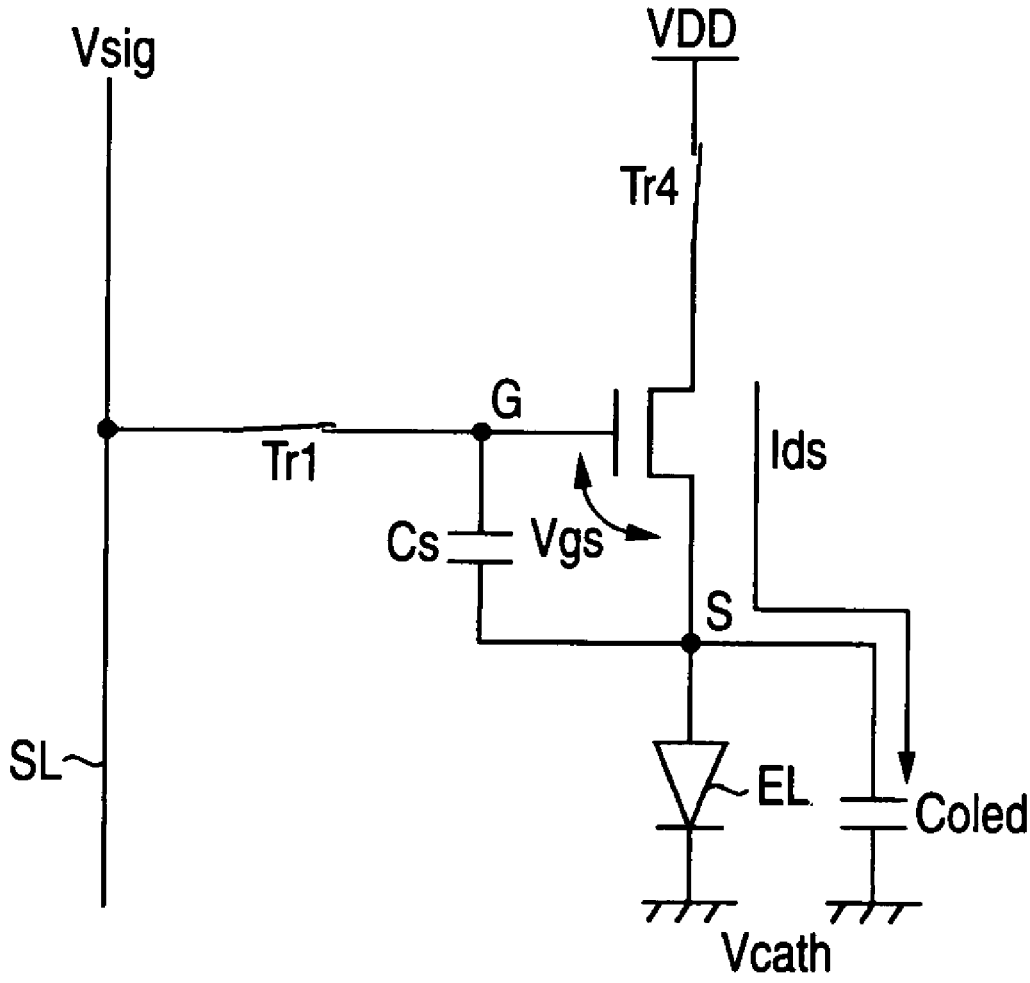
FIG. 5 is a circuit diagram for explanation of the operation of the display device.

FIG. 5 is a circuit diagram showing the state of the pixel circuit 2 in the mobility correction time T6-T7. As illustrated, in the mobility correction time T6-T7, the sampling transistor Tr1 and the switching transistor Tr4 are on, while the other switching transistors Tr2 and Tr3 are off. In this condition, the source potential (S) of the switching transistor Tr4 is Vss1−Vth. The source potential (S) is also an anode potential of the light emitting device EL. By setting Vss1−Vth<VthEL as described above, the light emitting device EL is in the reverse bias-state, and exhibits not the diode characteristic but the simple capacity characteristic. Thus, the current Ids flowing through the drive transistor Trd flows into the combined capacity of the pixel capacity Cs and the equivalent capacity Coled of the light emitting device EL, C=Cs+Coled. In other words, part of the drain current Ids is negatively fedback to the image capacity Cs and the mobility is corrected.

Figure 6:
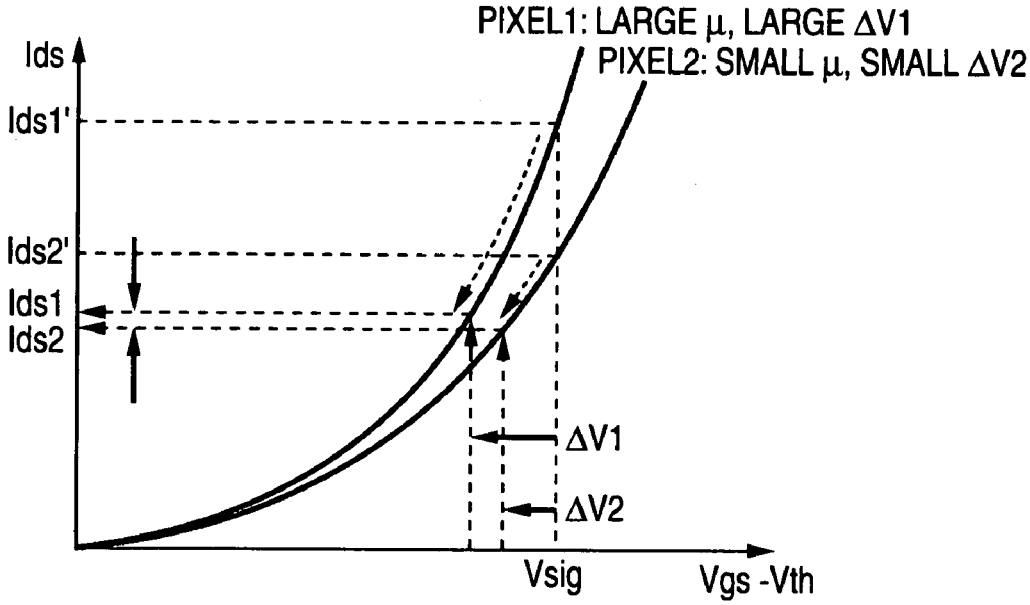
FIG. 6 is a graph for explanation of the operation of the display device.

FIG. 6 is a graphic representation of the above described transistor characteristic equation 2, and the vertical axis indicates Ids and the horizontal axis indicates Vsig. The transistor characteristic equation 2 is also shown below the graph. In the graph of FIG. 6, characteristic curves are depicted in comparison between pixel 1 and pixel 2. The mobility μ of the drive transistor of pixel 1 is relatively large. Contrary, the mobility μ of the drive transistor contained in pixel 2 is relatively small. In this manner, when the drive transistor is configured by a polysilicon thin film transistor or the like, variations in mobility μ among pixels are inevitable. For example, when the signal potentials Vsig of the video signal at the same level are written in the pixels 1, 2, respectively, if any mobility correction is not performed, the output current Ids1' flowing through the pixel 1 having the larger mobility μ is largely different from the output current Ids2' flowing through the pixel 2 having the smaller mobility μ. Thus, the large difference between output current Ids is caused due to variations in mobility μ, and thereby, streaks occur and the screen uniformity is deteriorated.

Accordingly, in the embodiment of the invention, variations in mobility are cancelled by negatively feedbacking the output current to the input voltage side. As clearly found from the above transistor characteristic equation 1, the larger the mobility, the larger the drain current Ids. Therefore, the larger the mobility, the larger the amount of negative feedback ΔV. As shown in the graph of FIG. 6, the amount of negative feedback ΔV1 of the pixel 1 having the larger mobility μ is larger than the amount of negative feedback ΔV2 of the pixel 2 having the smaller mobility μ. Therefore, the larger the mobility μ, the more largely the pixel is negatively fedback, and thereby, variations are suppressed. As illustrated, when the correction of ΔV1 is performed in the pixel 1 having the larger mobility μ, the output current largely drops from Ids1' to Ids1. On the other hand, since the amount of correction ΔV2 of the pixel 2 having the smaller mobility μ is small, the output current Ids2' is not so largely drops from Ids2' to Ids2. As a result, Ids1 and Ids2 become substantially equal, and the variation in mobility is cancelled. The cancelling of variations in mobility is performed in the entire range of Vsig from the black level to the white level, and thereby, the screen uniformity becomes extremely high. The above description will be summarized as follows. When there are pixels 1 and 2 having different mobility, the amount of correction ΔV1 of the pixel 1 having the larger mobility becomes smaller than the amount of correction ΔV2 of the pixel 2 having the smaller mobility. That is, the larger the mobility, the larger ΔV becomes and the larger the value of reduction of Ids becomes. Thereby, the current values of pixels having different mobility are equalized and variations in mobility can be corrected.

As below, a numeric analysis of the above described mobility correction will be performed for reference. An analysis will be made using the source potential of the drive transistor Trd as a variable V under the condition that the transistors Tr1 and Tr4 are on as shown in FIG. 5. Given that the source potential (S) of the drive transistor Trd is V, the drain current Ids flowing through the drive transistor Trd is as expressed by the following equation 3.

$$I_{ds}=K\mu(V_{gs}-V_{th})^2=K\mu(V_{sig}-V-V_{th}) \tag{3}$$

Further, according to the relationship between the drain current Ids and the capacity C (=Cs+Coled), Ids=dQ/dt=CdV/dt holds as expressed by the following equation 4.

$$\begin{aligned}
&\text{From } I_{ds}=\frac{dQ}{dt}=C\frac{dV}{dt},\\
&\int\frac{1}{C}dt=\int\frac{1}{I_{ds}}dV\\
&\Leftrightarrow\int_0^t\frac{1}{C}dt=\int_{-vth}^{v}\frac{1}{k\mu(V_{sig}-V_{th}-V)^2}dv\\
&\Leftrightarrow\frac{k\mu}{C}t=\left[\frac{1}{V_{sig}-V_{th}-V}\right]_{-vth}^{v}=\frac{1}{V_{sig}-V_{th}-V}-\frac{1}{V_{sig}}\\
&\Leftrightarrow V_{sig}-V_{th}-V=\frac{1}{\frac{1}{V_{sig}}+\frac{k\mu}{C}t}=\frac{V_{sig}}{1+V_{sig}\frac{k\mu}{C}t}
\end{aligned} \tag{4}$$

Eq. 3 is substituted into Eq. 4 and both sides are integrated. Here, the initial condition of the source voltage V is −Vth, and the mobility variation correction time (T6-T7) is t. By solving the differential equation, the pixel current for the mobility correction time t is given as the following equation 5.

$$I_{ds}=k\mu\left(\frac{V_{sig}}{1+V_{sig}\frac{k\mu}{C}t}\right)^2 \tag{5}$$

Figure 7:
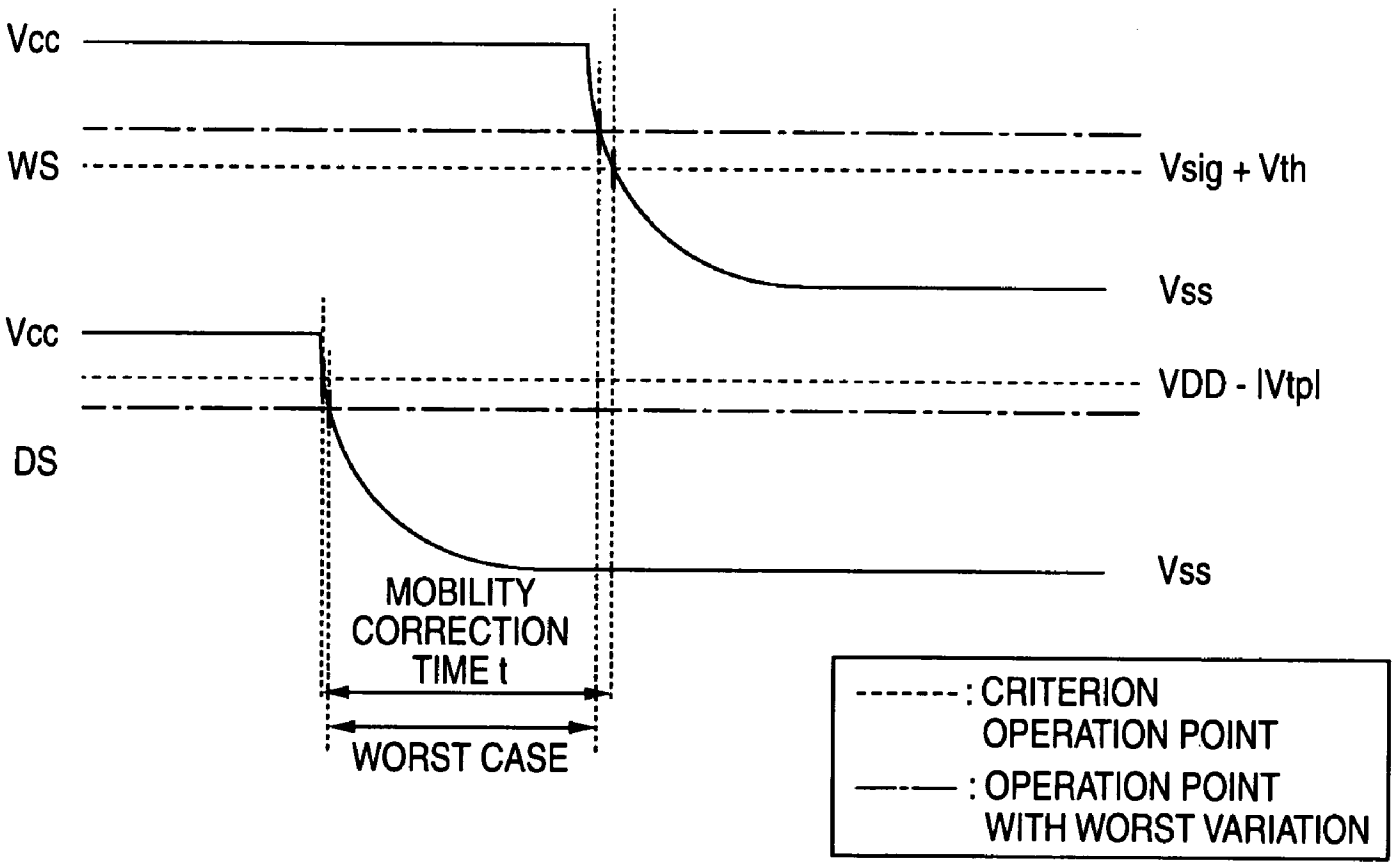
FIG. 7 is a waveform chart for explanation of the operation of the display device.

As described above, the output current flowing through the light emitting device of each pixel is as expressed by Eq. 5. In Eq. 5, the mobility correction time t is set to several microseconds at the practical level. As described above, the mobility correction time is determined by the interval between the on-timing of the switching transistor Tr4 (falling timing) and the off-timing of the sampling transistor Tr1 (rising timing). FIG. 7 shows a falling waveform of the control signal DS applied to the gate of the switching transistor Tr4 and a falling waveform of the control signal WS applied to the gate of the sampling transistor Tr1 along the same time axis. The scan lines through which these control signals DS, WS propagate are relatively high resistance pulse wirings of metallic molybdenum or the like. Further, since the overlap parasitic capacity with wirings of other layers is large, the time constants of these pulse wirings are large and the falling waveforms of the control signals DS and WS are dull. That is, the respective control signals DS, WS do not instantaneously rise from the power supply potential Vcc to the ground potential Vss, but the falling waveforms become dull due to the influences of the time constants determined by the wiring resistances and wiring capacities. The falling waveforms are applied to the gates of the switching transistor Tr4 and the sampling transistor Tr1.

On the other hand, the signal potential Vsig is supplied to the source of the sampling transistor Tr1. Accordingly, the sampling transistor Tr1 turns off when the gate potential is below Vsig+Vtn. Vtn is the threshold voltage of the N-channel sampling transistor Tr1. Generally, the threshold voltage Vtn of the sampling transistor Tr1 varies with respect to each pixel due to the influence of the manufacturing process or the like. Therefore, if the falling waveform of the control signal WS is dull, the off-timing of the sampling transistor Tr1 shifts due to the influence of the variation in the threshold voltage Vtn. Thus, a difference appears in the end of the mobility correction time t with respect to each pixel.

Similarly, the source of the switching transistor Tr4 is connected to the power supply potential VDD of the pixel. Accordingly, when the gate potential of the switching transistor Tr4 falls to the VDD−|Vtp|, the switching transistor Tr4 turns on. Here, Vtp represents the threshold voltage of the P-channel switching transistor Tr4. The threshold voltage Vtp also varies due to the influence of the manufacturing process. Therefore, if the falling waveform of the control signal DS is dull, the on-timing of the switching transistor Tr4 shifts due to the influence of the variation in the threshold voltage Vtp. That is, a difference appears in the start of the mobility correction time t with respect to each pixel. FIG. 7 shows criterion operation points when the threshold voltages Vtn, Vtp are at the average levels by dotted lines, and operation points when variations in Vtn and Vtp are the worst by dashed-dotted lines. The mobility correction time is shorter in the worst case relative to the criterion mobility correction time t. Contrary, the mobility correction time may be longer in the worst case relative to the average mobility correction time t.

Figure 8:
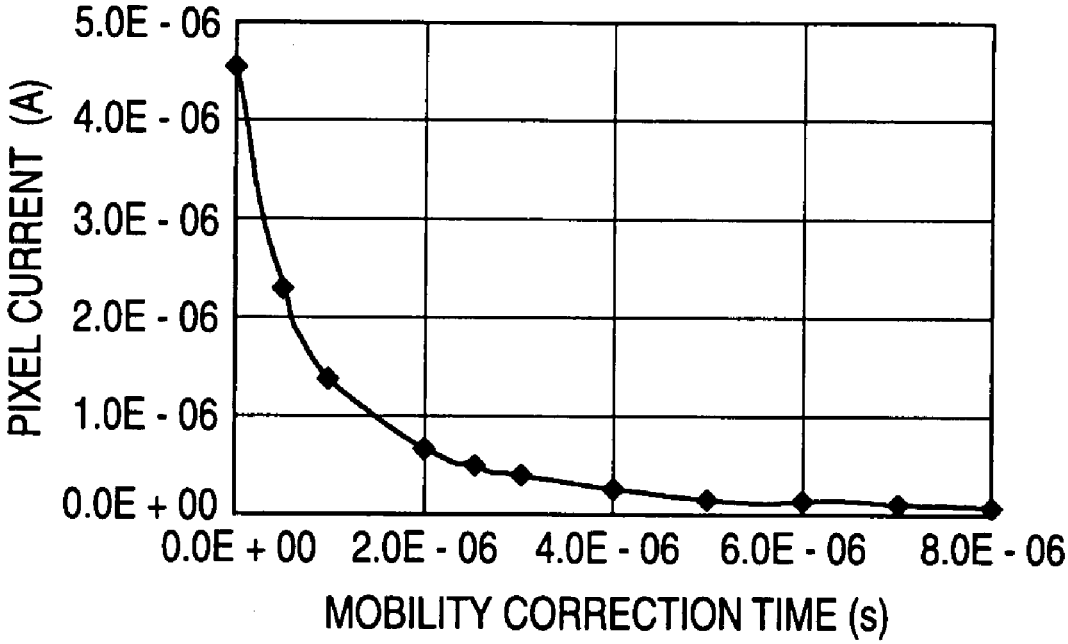
FIG. 8 is a graph for explanation of the operation of the display device.

FIG. 8 is a graph showing the relationship between the mobility correction time and the drive current (pixel current) flowing through the pixel. In the graph, the horizontal axis indicates the mobility correction time and the vertical axis indicates the pixel current. As clearly found from the graph, when the mobility correction time varies, the pixel current varies with respect to each pixel. Thereby, the screen uniformity is deteriorated. As described above, the variations in mobility correction time are principally caused by the variations in threshold voltages of the sampling transistor Tr1 and the switching transistor Tr4.

Figure 9:
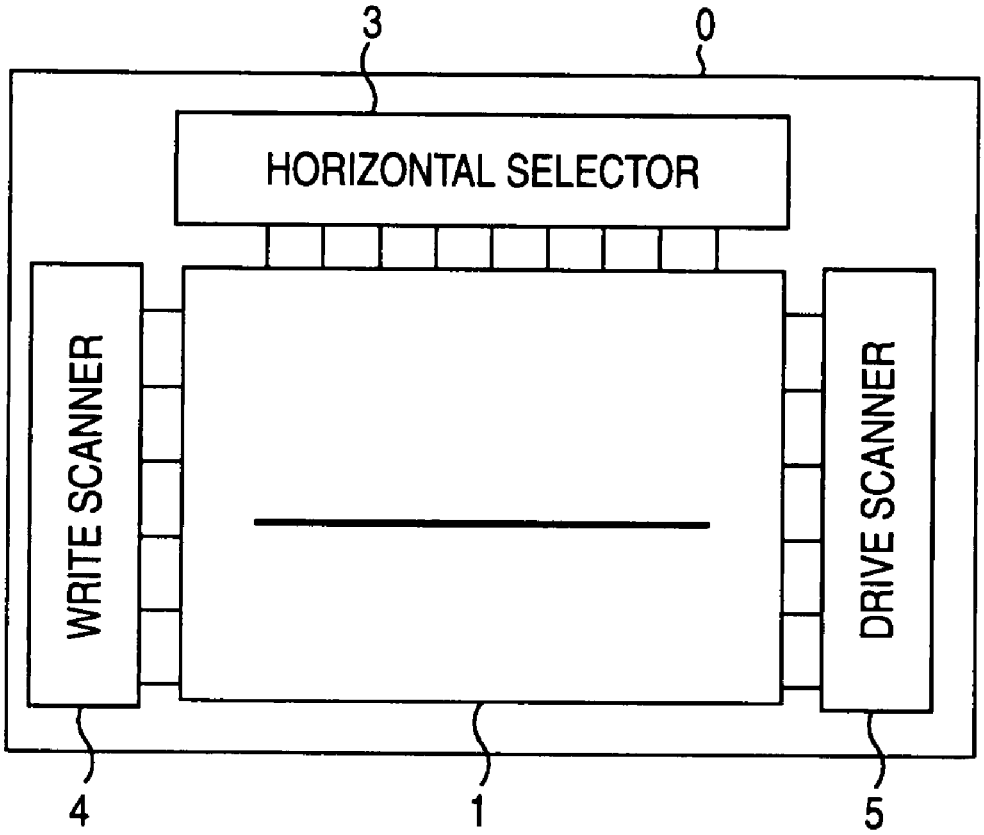
FIG. 9 is a schematic diagram for explanation of the operation of the display device.

FIG. 9 is a schematic diagram for explanation of the cause of variations in the threshold voltage of the thin-film transistor. As illustrated, the display device is a flat panel 0 formed by one insulating substrate. On the panel 0, in addition to the pixel array part 1, the surrounding write scanner 4, drive scanner 5, and horizontal selector 3 are integrally formed. These surrounding drive parts as well as the pixel array part 1 in the center are integrally formed with the thin-film transistors. Generally, the thin-film transistor has a polysilicon film as a device region. For example, an amorphous silicon thin film is deposited on an insulating substrate, then, crystallized by applying a laser beam so that the thin film is converted into a polysilicon thin film. The application of laser beam converts the amorphous silicon film into the polysilicon film by sequentially applying linear laser beams from top to bottom of the panel 0 while overlapping them. In the laser beam application process, when a local variation occurs in the laser output, the crystallinity of the polysilicon film differs along the vertical direction of the panel 0, and consequently, this appears as variations in the threshold voltage of the thin-film transistor. Therefore, the variations in the threshold voltage typically appear in the horizontal direction of the panel 0 along the lines of laser beams. In the illustrated example, the correction time varies due to variations in the threshold voltage in some lines. As shown in FIG. 8, the variations in correction time lead to variations in pixel current, and thus, streaky uneven brightness appears along the lines. When the correction time is shorter than the average, the amount of negative feedback for the signal potential is smaller, and thus, lighter streaks than surroundings occur. Contrary, when the correction time is longer than the criterion, the amount of negative feedback for the signal potential increases, the signal potential decreases, and thus, darker streaks than surroundings occur by the decrease.

Figure 10:
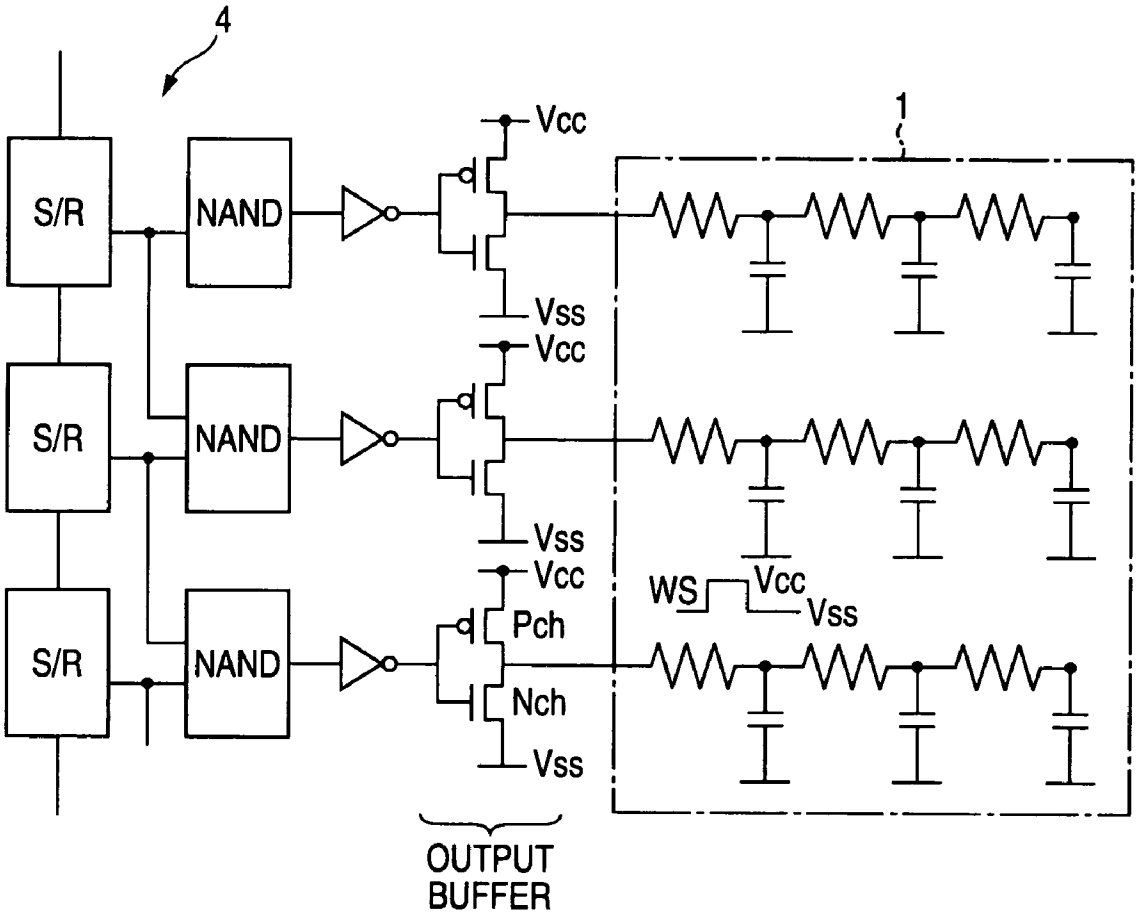
FIG. 10 is a circuit diagram showing a display device of the first embodiment according to the invention.

In the current flat panel market, products with higher screen brightness are in demand. Accordingly, it is necessary to shorten the mobility correction time that acts on the signal potential to be reduced. When the mobility correction time is made shorter, streaks due to uneven brightness are noticeable with a slight shift of duration. The variations in correction time are principally caused by variations in threshold voltages of the switching transistor and the sampling transistor. Accordingly, the basic concept of the invention is to make the transition waveforms of the control signal pulses applied to the gates of these transistors steeper so that, if the threshold voltages of the transistors vary, the correction time itself may not vary. FIG. 10 is a schematic circuit diagram showing the first embodiment created based on the basic concept of the invention. FIG. 10 schematically shows three stages of output units of the write scanner 4 and three columns (three lines) of the pixel array part 1 connected thereto.

The write scanner 4 is configured by a shift register S/R, operates in response to the clock signal WSCK externally input, and sequentially outputs signals with respect to each stage by sequentially transferring start signals WSST externally input. NAND elements are connected to the respective stages of the shift registers S/R, and perform NAND processing on sequential signals output from the adjacent stages of S/R to generate rectangular waveforms from which the control signals WS are formed. The rectangular waveforms are input to output buffers via invertors. The output buffers operate in response to input signals supplied from the shift registers' side, and supply final control signals WS to the corresponding scan lines WS of the pixel array part 1.

The output buffer includes a pair of switching elements series-connected between the power supply potential Vcc and the ground potential Vss. In the embodiment, the output buffer has an inverter configuration, and one switching element is a P-channel transistor Pch (typically, a PMOS transistor) and the other is N-channel transistor Nch (typically, a NMOS transistor). The respective lines at the pixel array part 1 side connected to the respective output buffers are represented by an equivalent circuit, with a resistance component and a capacity component.

In the output buffer having the inverter configuration, the P-channel transistor Pch and the N-channel transistor Nch are alternately turned on for outputting a rectangular pulse of the control signal WS. When the P-channel transistor Pch is turned on, the output node of the inverter is abruptly elevated to the power supply potential Vcc side. That is, the P-channel transistor Pch principally forms the rising waveform of the control signal WS. On the other hand, when the N-channel transistor Nch is turned on, the output node of the inverter is abruptly dropped to the ground line potential Vss side. In other words, the N-channel transistor Nch principally forms the falling waveform of the control signal WS.

By the way, in the waveform chart shown in FIG. 7, the falling waveform of the control signal WS determines the end of the mobility correction time t. In the embodiment, the falling waveform of WS is a determining waveform, and the rising waveform is a non-determining waveform because it is not involved in any determination of mobility correction time. On the other hand, in the output buffer, the P-channel transistor Pch forms the rising part and the N-channel transistor Nch principally forms the falling part. Therefore, in the embodiment of FIG. 10, the N-channel transistor Nch is a superior switching element that forms the determining waveform of the control signal WS, and the P-channel transistor Pch is an inferior switching element that forms the non-determining waveform of the control signal WS. The superior switching element and the inferior switching element are so called only for convenience of correspondence of the determining waveform with the non-determining waveform, and there is no qualitative difference between them. In the embodiment, in order to suppress the variations in mobility correction time, the steepness of the determining waveform is made greater by setting the size of the N-channel transistor Nch forming the determining waveform larger than that of the P-channel transistor Pch. Thereby, even if the threshold voltage Vth of the sampling transistor Tr1 at the pixel array part 1 side varies, the end of the mobility correction time no longer varies.

Figure 11:
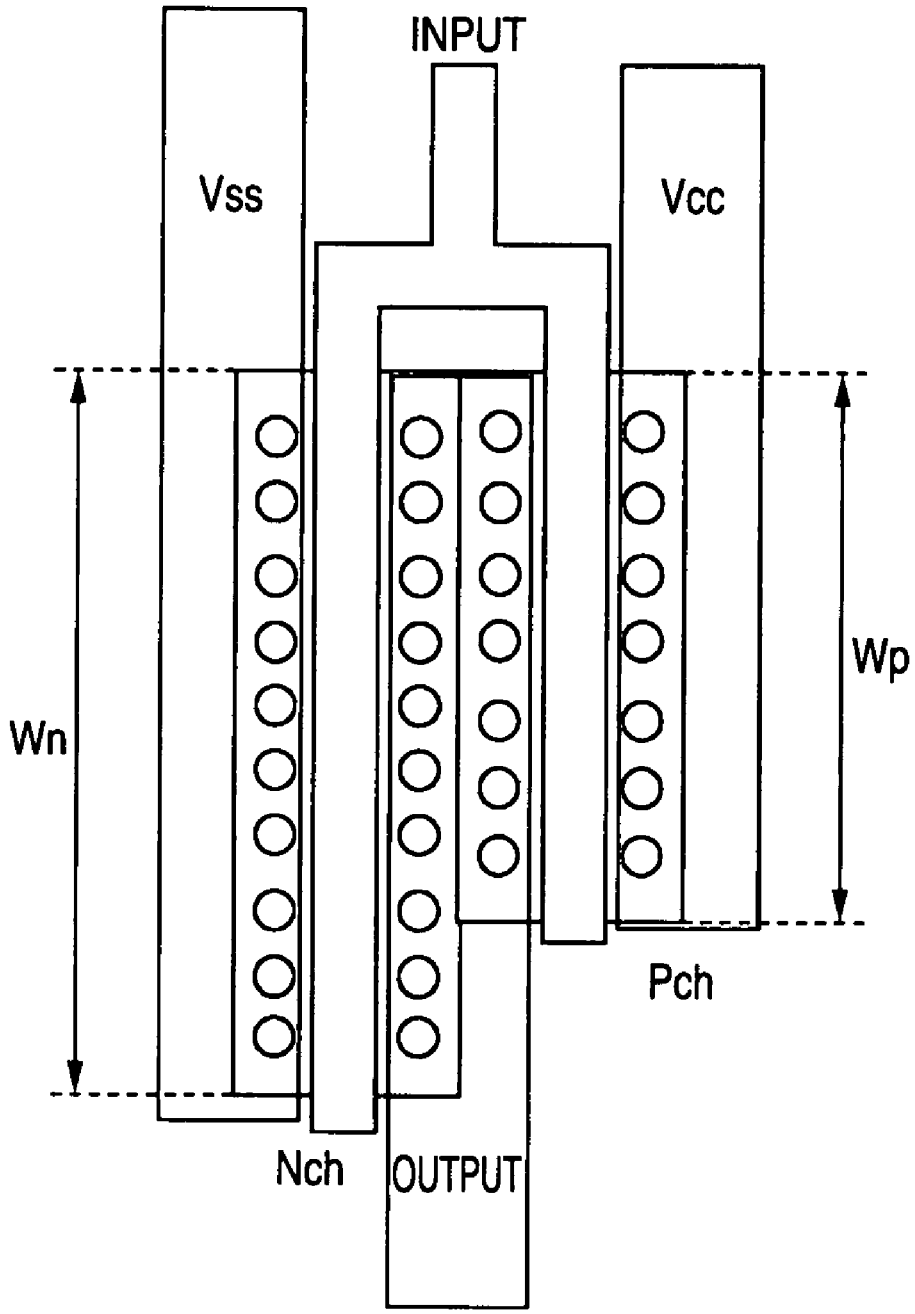
FIG. 11 is a gate pattern diagram showing the display device of the first embodiment.

FIG. 11 is a schematic plan view showing a gate pattern of the output buffer shown in FIG. 10. As illustrated, the output buffer has an inverter configuration, and the P-channel transistor Pch and the N-channel transistor Nch are provided in series between the power supply potential Vcc and the ground potential Vss. Input signals are applied to the gate sides of the pair of the P-channel transistor Pch and the N-channel transistor Nch, and output signals are drawn from the drain sides. As described above, in the output buffer, the channel width Wn of the N-channel transistor Nch as the superior switching element is set larger than the channel width Wp of the P-channel transistor Pch at the inferior switching element side. The channel lengths L of the N-channel transistor Nch and the P-channel transistor Pch are set equal to each other.

Figure 12:
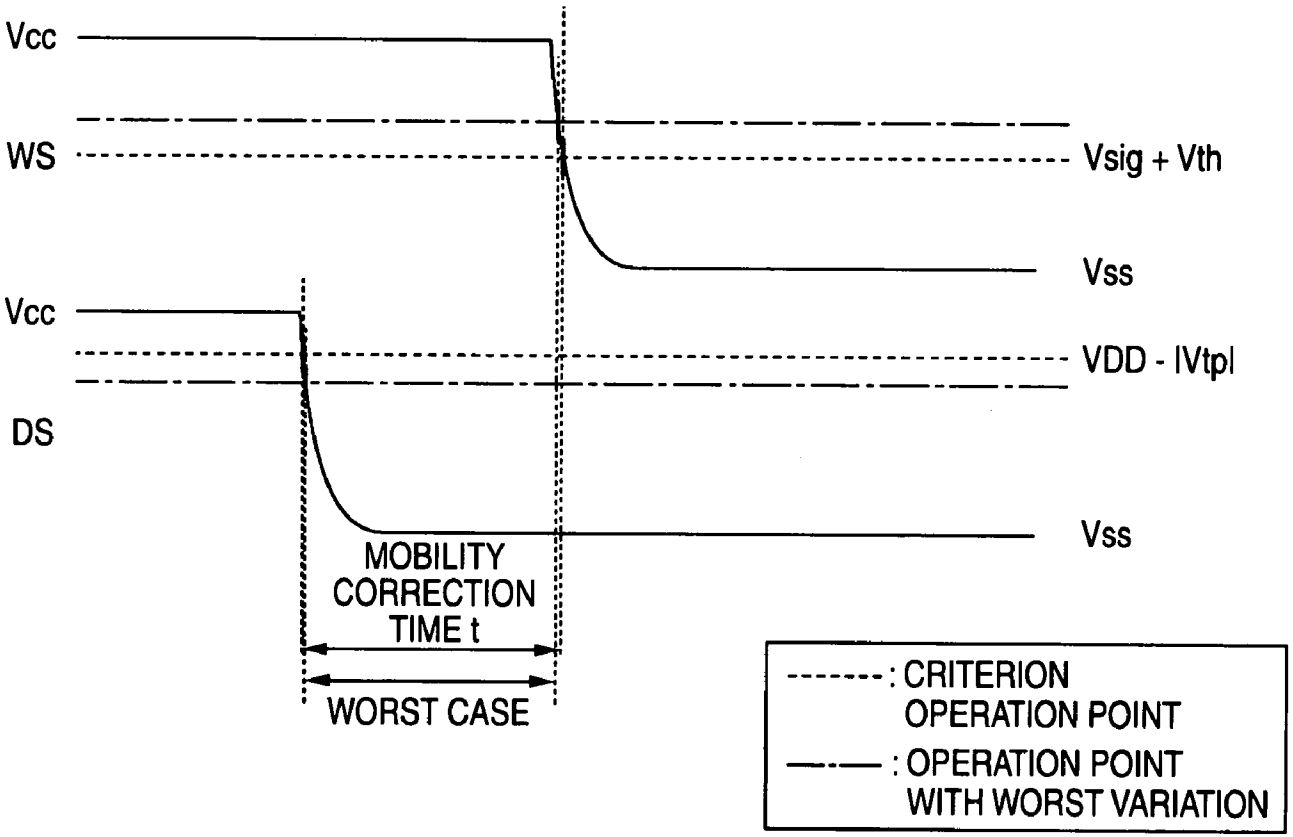
FIG. 12 is a waveform chart showing the display device of the first embodiment.

FIG. 12 is a waveform chart showing the falling waveform (determining waveform) of the control signal WS output from the output buffer shown in FIG. 11. The time axis and the falling waveform (determining waveform) of the control signal DS are shown together. For easy understanding, the waveform chart of FIG. 12 is shown on the same scale as that of the waveform chart shown in FIG. 7. As clearly found in comparison between FIG. 7 and FIG. 12, the falling waveform of the control signal WS is steeper. Similarly, the falling waveform of the control signal DS is made steeper by designing the corresponding output buffer. In this manner, the determining waveforms of the respective control signals WS, DS are made steeper, and thereby, even when the threshold voltage Vtn of the sampling transistor Tr1 and the threshold voltage Vtp of the switching transistor Tr4 vary, the mobility correction time t does not largely vary. As clearly found in comparison between FIG. 7 and FIG. 12, the difference between the average case and the worst case of the mobility correction time is smaller in FIG. 12.

Figure 13B:
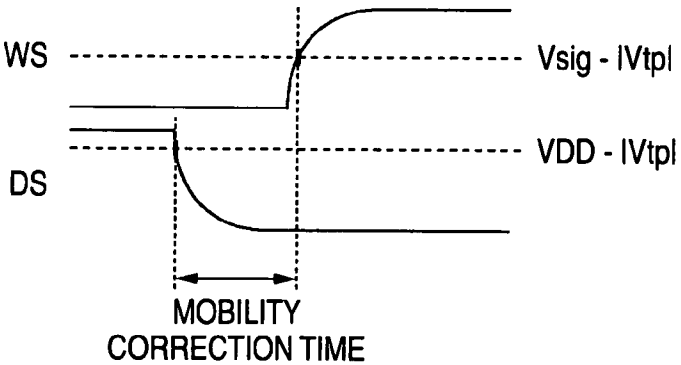
FIGS. 13A to 13C are schematic diagrams showing a display device of the second embodiment according to the invention.
Figure 13C:
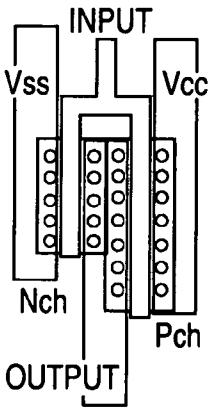
Figure 13A:
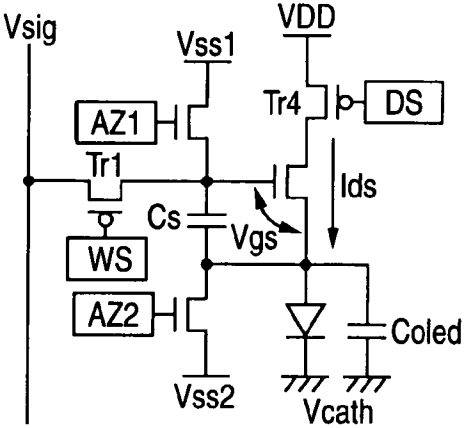

FIGS. 13A to 13C are schematic diagrams showing a display device of the second embodiment according to the invention. FIG. 13A shows a pixel configuration, FIG. 13B shows waveforms of control signals WS and DS, and FIG. 13C shows a gate pattern of an output buffer of the write scanner. As shown in FIG. 13A, the embodiment uses a P-channel transistor as the sampling transistor Tr1. Accordingly, as shown in FIG. 13B, the determining waveform of the control signal WS applied to the sampling transistor Tr1 is not the falling waveform shown in FIG. 12, but a rising waveform. Therefore, as shown in FIG. 13C, in the output buffer of the write scanner that supplies the control signal WS, the P-channel transistor is a superior switching element that principally forms the rising waveform of the control signal WS, and the N-channel transistor is an inferior switching element on the contrary. In the embodiment, in order to make the determining waveform steeper, the channel width of the P-channel transistor at the superior switching element side is made wider than the channel width of the N-channel transistor at the inferior switching element side.

Figure 14A:
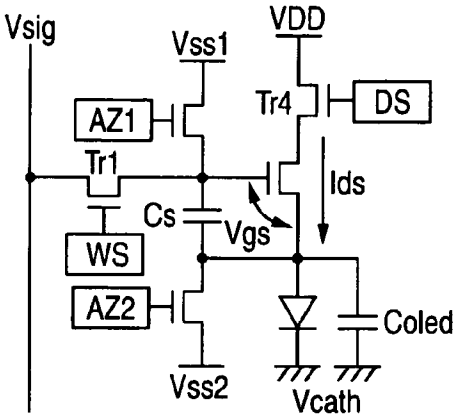
FIGS. 14A to 14C are schematic diagrams showing a display device of the third embodiment according to the invention.
Figure 14B:
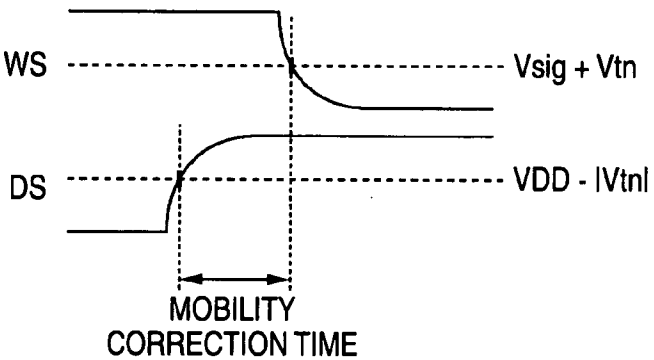
Figure 14C:
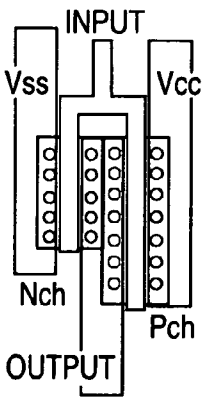

FIGS. 14A to 14C are schematic diagrams showing a display device of the third embodiment according to the invention. As shown in FIG. 14A, the embodiment uses an N-channel transistor as the switching transistor Tr4. Accordingly, as shown in FIG. 14B, the rising waveform of the control signal DS is the determining waveform that determines the start of the mobility correction time. As shown in FIG. 14C, in the output buffer of the drive scanner 5 that supplies the control signal DS, the channel width of the P-channel transistor at the superior switching element side that forms the determining waveform is made wider than the channel width of the N-channel transistor at the inferior switching element side. Thereby, the rising waveform of the control signal DS can be made steeper than the falling waveform.

Figure 15:
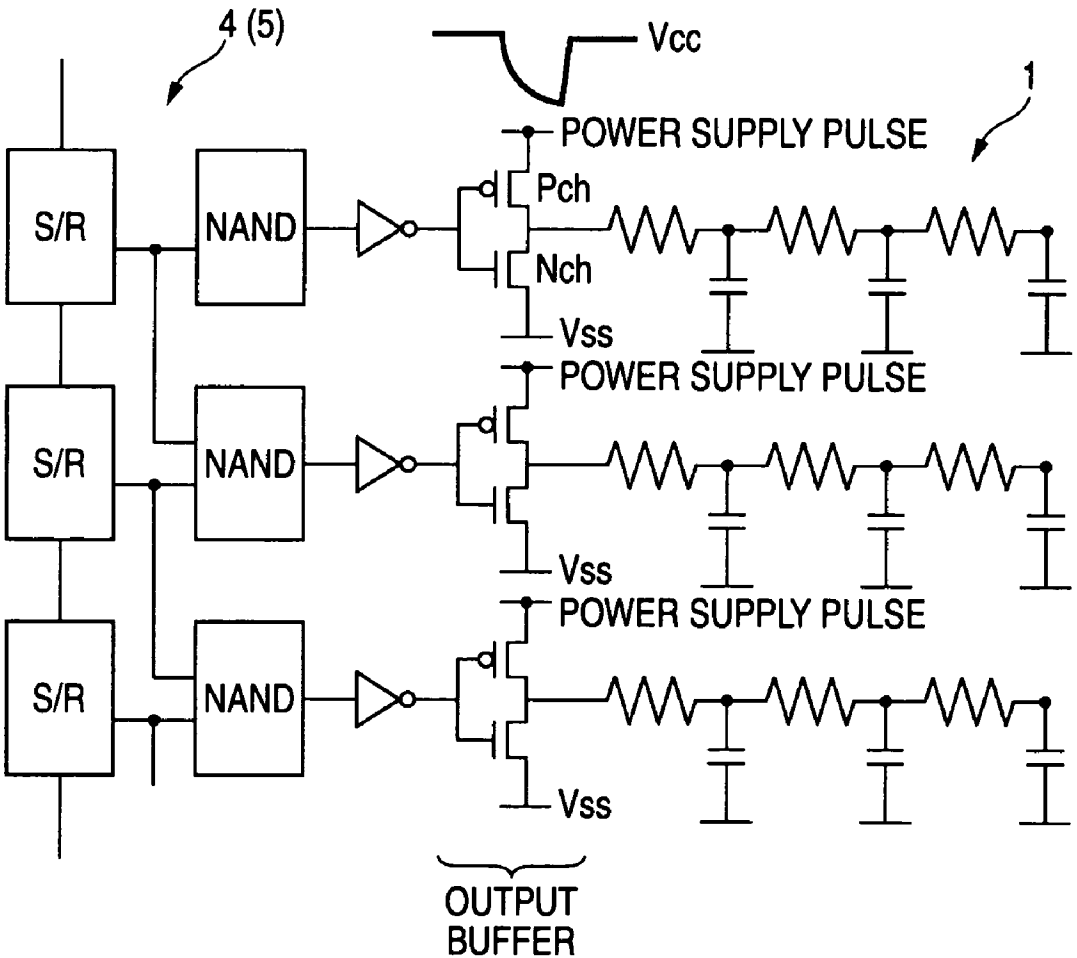
FIG. 15 is a circuit diagram showing a display device of the fourth embodiment according to the invention.

FIG. 15 is a schematic circuit diagram showing a display device of the fourth embodiment according to the invention. The left side of the circuit diagram shows the output stage of the write scanner 4 and the drive scanner 5, and the right side shows the corresponding lines of the pixel array part 1. The embodiment has a configuration in which the output buffer draws the power supply pulse supplied to the power supply line and forms the determining waveform of the control signal. As illustrated, also the output buffer has an inverter configuration, and the P-channel transistor Pch and the N-channel transistor Nch are series-connected between the power supply line and the ground potential Vss. When the P-channel transistor Pch of the output buffer is turned on in response to the input signal from the shift register S/R side, the output buffer draws the falling waveform of the power supply pulse supplied to the power supply line and supplies it as the determining waveform of the control signal WS to the pixel array part 1 side. In this manner, the pulse containing the determining waveform is formed separately from the output buffer and supplies to the power supply line of the output buffer, and thereby, the control signal WS having a desired determining waveform can be formed. Also in this case, when the P-channel transistor Pch at the superior switching channel side is turned on and the N-channel transistor Nch at the inferior switching channel side is turned off, the output buffer draws the falling waveform of the power supply pulse externally supplied and outputs it as the determining waveform of the control signal WS or DS.

Figure 16:
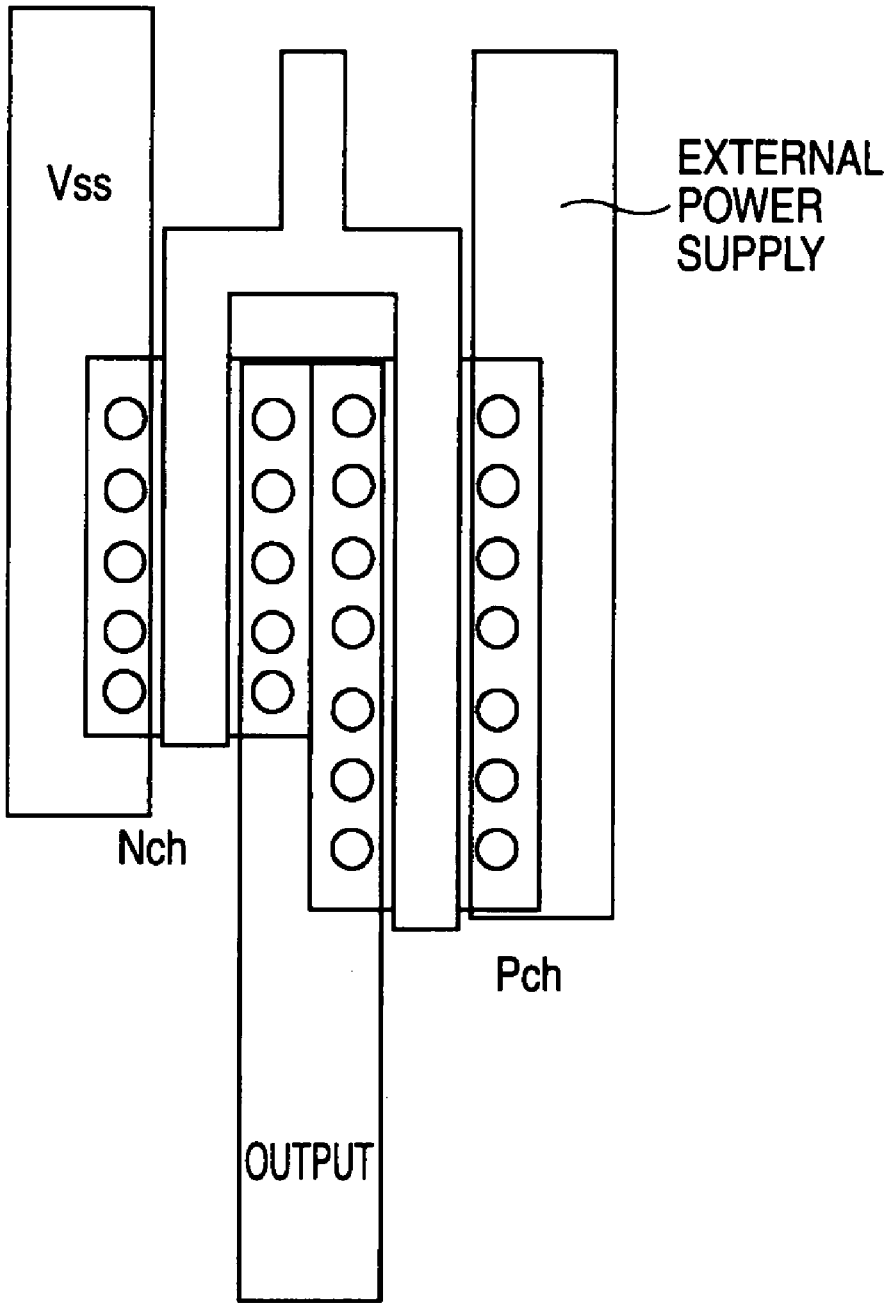
FIG. 16 is a gate pattern diagram showing the display device of the fourth embodiment.

FIG. 16 is a schematic diagram showing a gate pattern of the output buffer shown in FIG. 15. As illustrated, a pair of P-channel transistor Pch and N-channel transistor Nch having inverter configuration are series-connected between the external power supply that generates the power supply pulse and the ground line Vss. In the embodiment, the P-channel transistor Pch is the superior switching element and the N-channel transistor Nch is the inferior switching element, and the channel width of the P-channel transistor is set wider than the channel width of the N-channel transistor. Since the current drive performance of the P-channel transistor is high as described above, the P-channel transistor can draw the determining waveform of the power supply pulse supplied from the external power supply as it is with little distortion as the determining waveform of the control signal.

Figure 17:
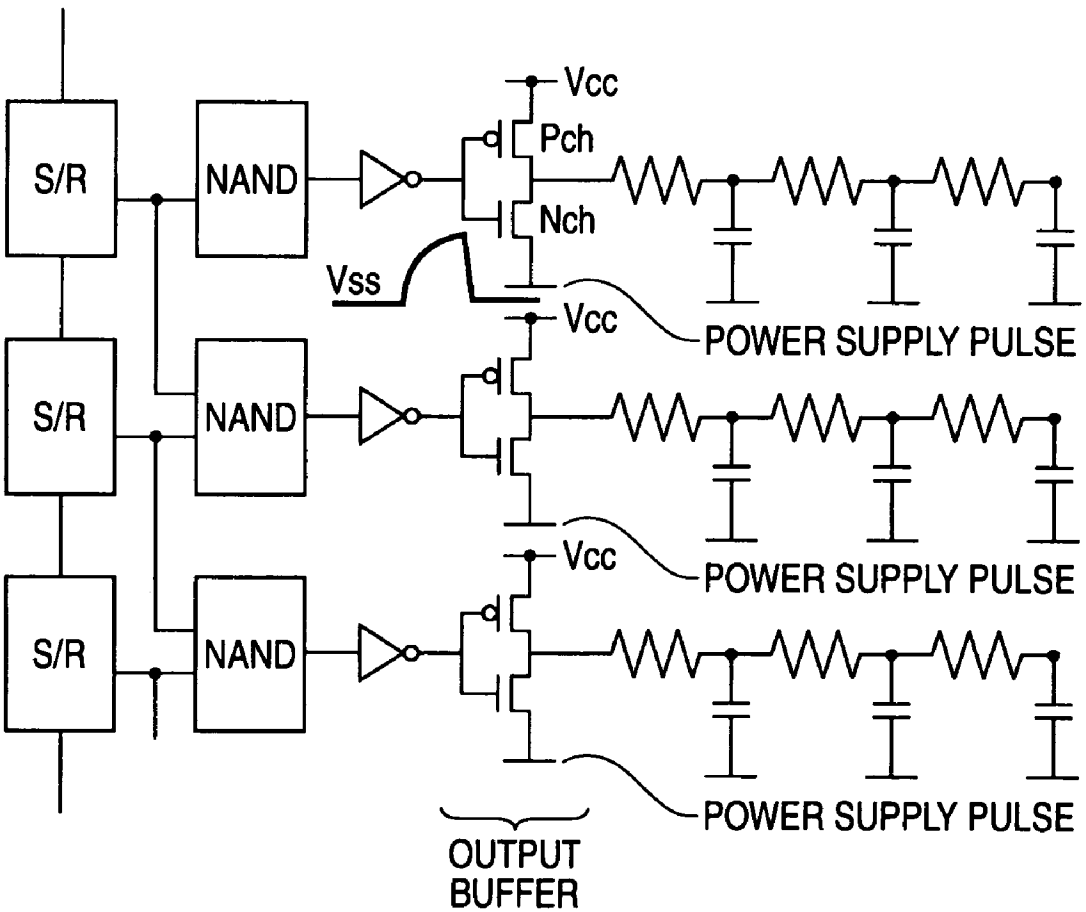
FIG. 17 is a schematic diagram showing a display device of the fifth embodiment according to the invention.

FIG. 17 is a schematic circuit diagram showing a display device of the fifth embodiment according to the invention. The corresponding reference numbers are assigned to the parts corresponding to the parts of the fourth embodiment shown in FIG. 15 for easy understanding. The point different from the fourth embodiment is that the fifth embodiment draws the rising waveform of the power supply pulse and uses it as the determining waveform of the control signal. Accordingly, the embodiment inputs the power supply pulse to the output buffer from the ground line Vss side, draws the rising waveform of the power supply pulse when the N-channel transistor Nch is turned on, and outputs it to the scan line side of the pixel array part. Therefore, in the embodiment, the N-channel transistor Nch of the output buffer is the superior switching element and the P-channel transistor Pch is the inferior switching element.

Figure 18:
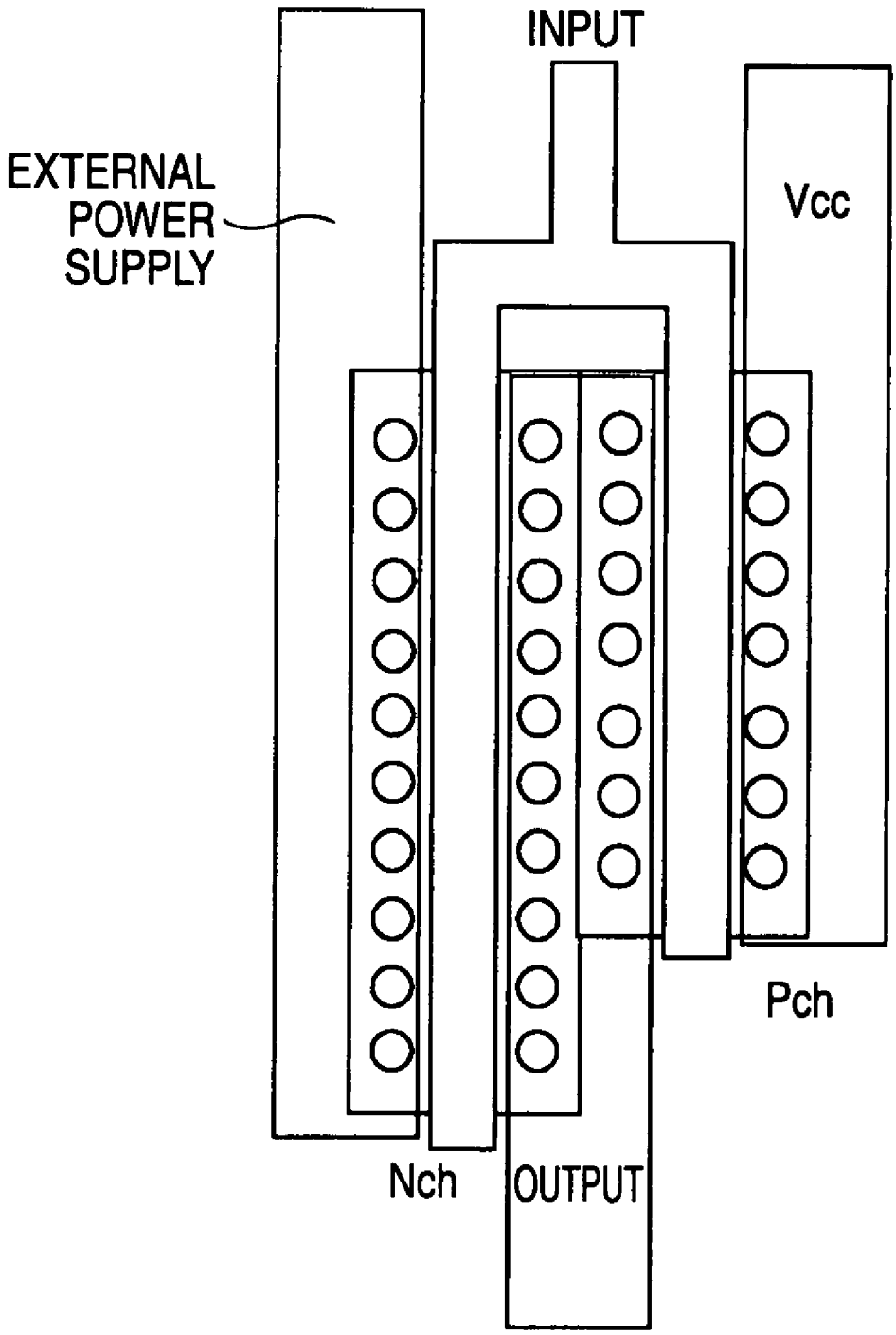
FIG. 18 is a gate pattern diagram showing the display device of the fifth embodiment.

FIG. 18 is a schematic diagram showing a gate pattern of the output buffer shown in FIG. 17. As illustrated, the channel width (gate width) of the N-channel transistor Nch at the superior switching element side is set wider than the channel width of the P-channel transistor Pch at the inferior switching element side.

Figure 19:
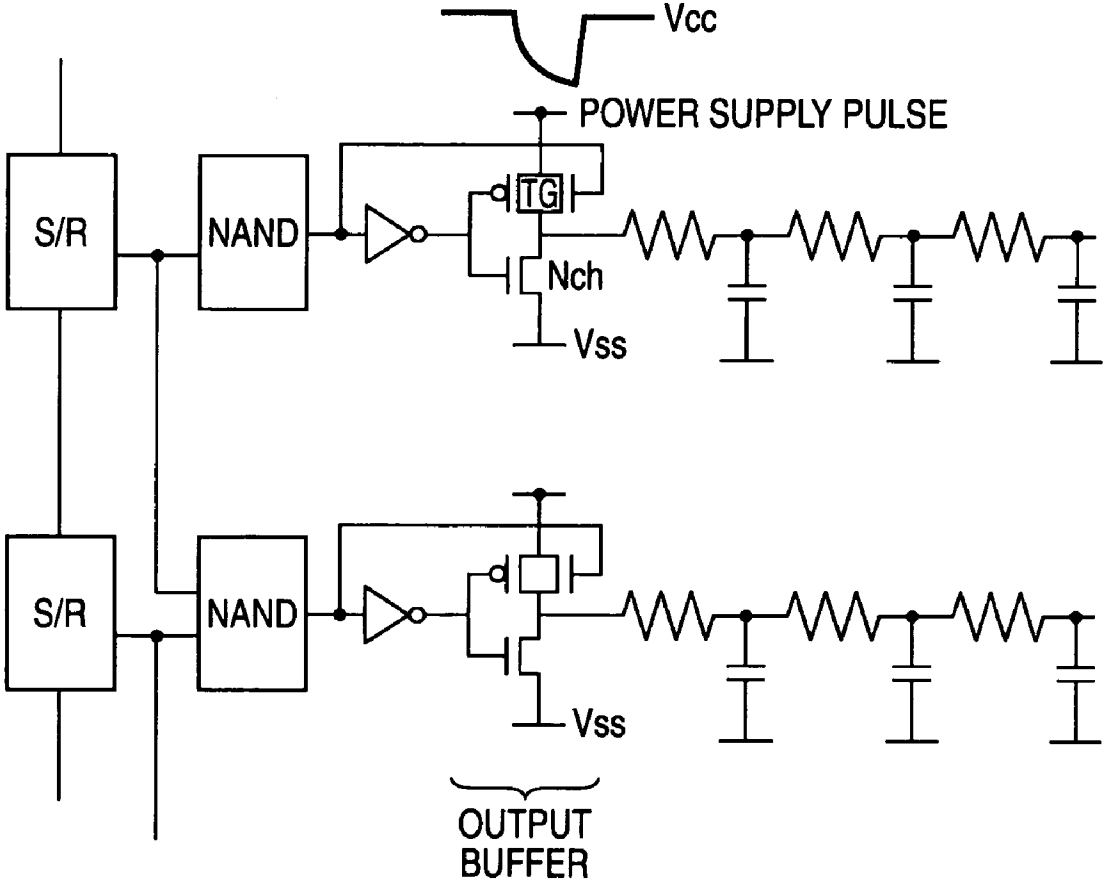
FIG. 19 is a circuit diagram showing a display device of the sixth embodiment according to the invention.

FIG. 19 is a schematic circuit diagram showing a display device of the sixth embodiment according to the invention. The corresponding reference numbers are assigned to the parts corresponding to the parts of the fourth embodiment shown in FIG. 15 for easy understanding. The point different from the fourth embodiment is that the sixth embodiment uses a transmission gate element (TG) including a CMOS transistor as the superior switching element in place of the P-channel transistor (typically, PMOS transistor). Such a CMOS switch has higher current drive performance compared to the NMOS switch or PMOS switch, and thus, can draw the falling waveform of the power supply pulse supplied to the power supply line without substantial deterioration and output it to the scan line side of the pixel array part as it is.

Figure 20:
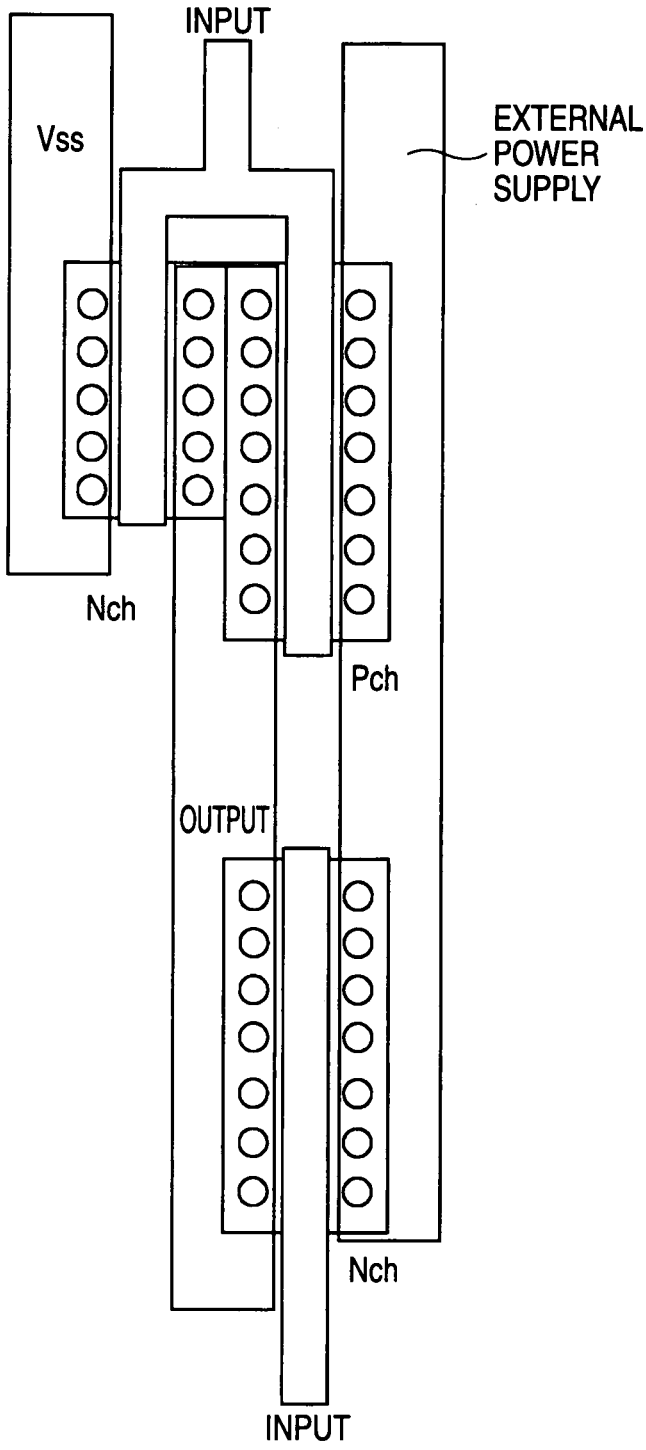
FIG. 20 is a gate pattern diagram showing the display device of the sixth embodiment.

FIG. 20 is a gate pattern diagram of the output buffer shown in FIG. 19. As illustrated, the output buffer series-connects a CMOS switch and an NMOS switch between the external power supply side and the ground line Vss. The CMOS switch includes a pair of P-channel transistor Pch and N-channel transistor Nch. The NMOS switch includes a single N-channel transistor Nch. As illustrated, the gate widths of the N-channel transistor and the P-channel transistor at the superior switching element side are set wider than the gate width of the N-channel transistor at the inferior switching element side.

Figure 21:
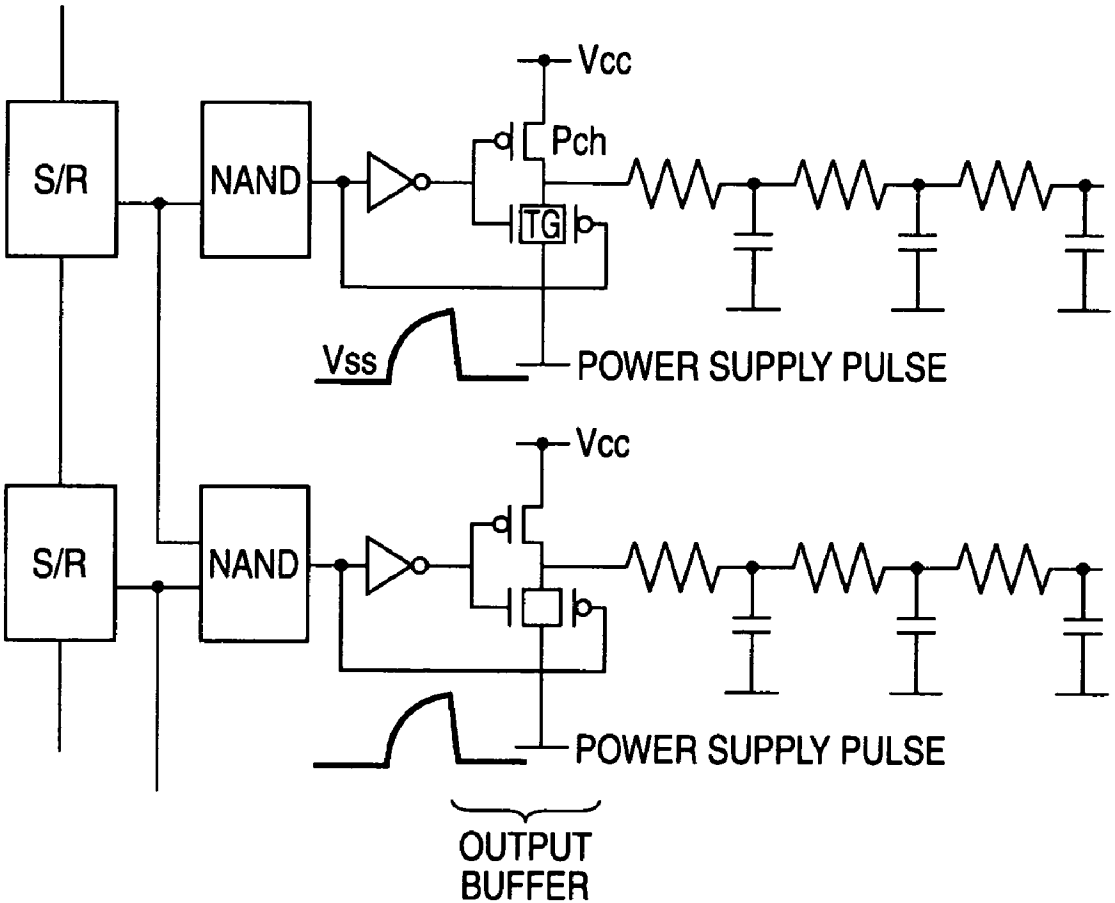
FIG. 21 is a circuit diagram showing a display device of the seventh embodiment according to the invention.

FIG. 21 is a schematic circuit diagram showing a display device of the seventh embodiment according to the invention.

The corresponding reference numbers are assigned to the parts corresponding to the parts of the sixth embodiment shown in FIG. 19 for easy understanding. The point of difference is that the seventh embodiment enters the power supply pulse from the ground line Vss side, draws the falling waveform of the power supply pulse with the transmission gate element TG including the CMOS transistor, and outputs it to the scan line side of the pixel array part.

Figure 22:
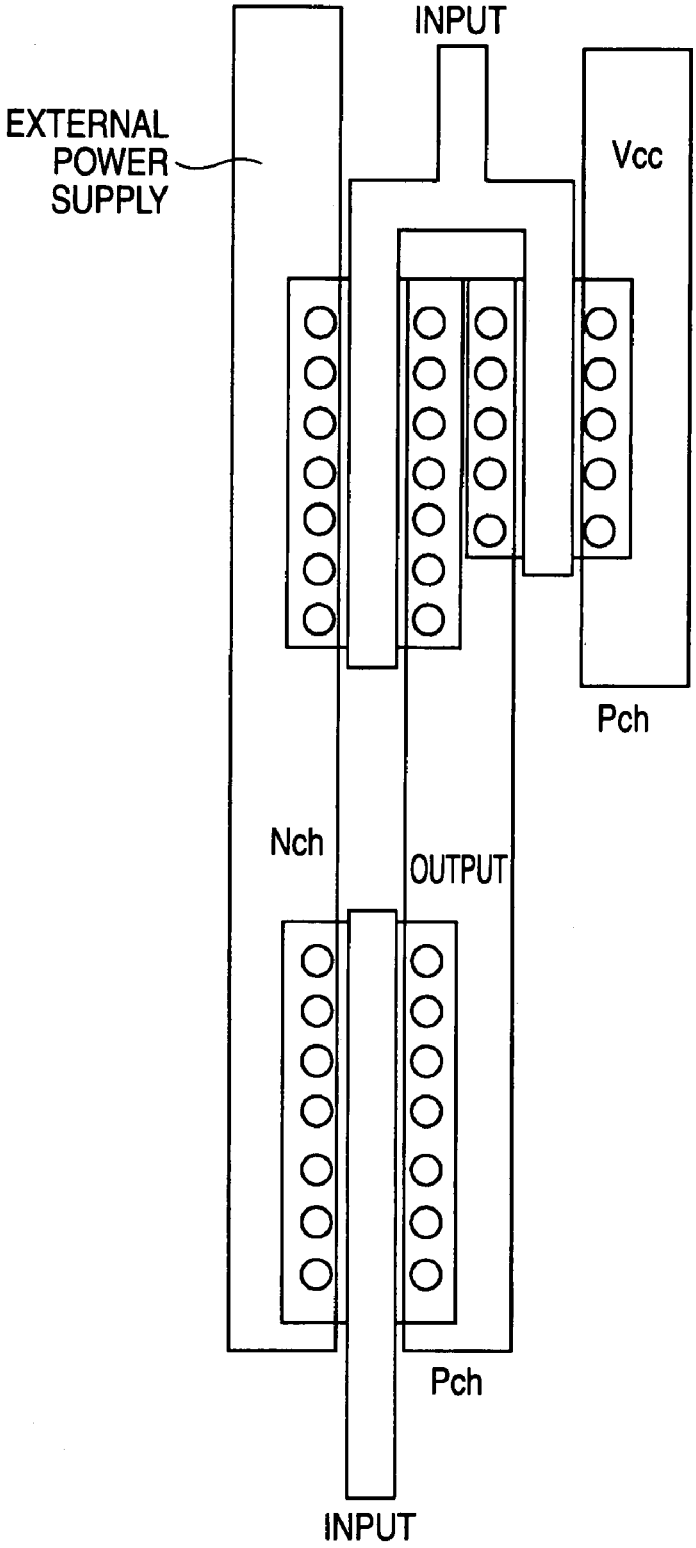
FIG. 22 is a gate pattern diagram showing the display device of the seventh embodiment.

FIG. 22 is a gate pattern diagram of the output buffer shown in FIG. 21. As illustrated, the gate widths of the N-channel transistor and the P-channel transistor at the superior switching element side are set wider than the gate width of the P-channel transistor at the inferior switching element side.

Figure 23:
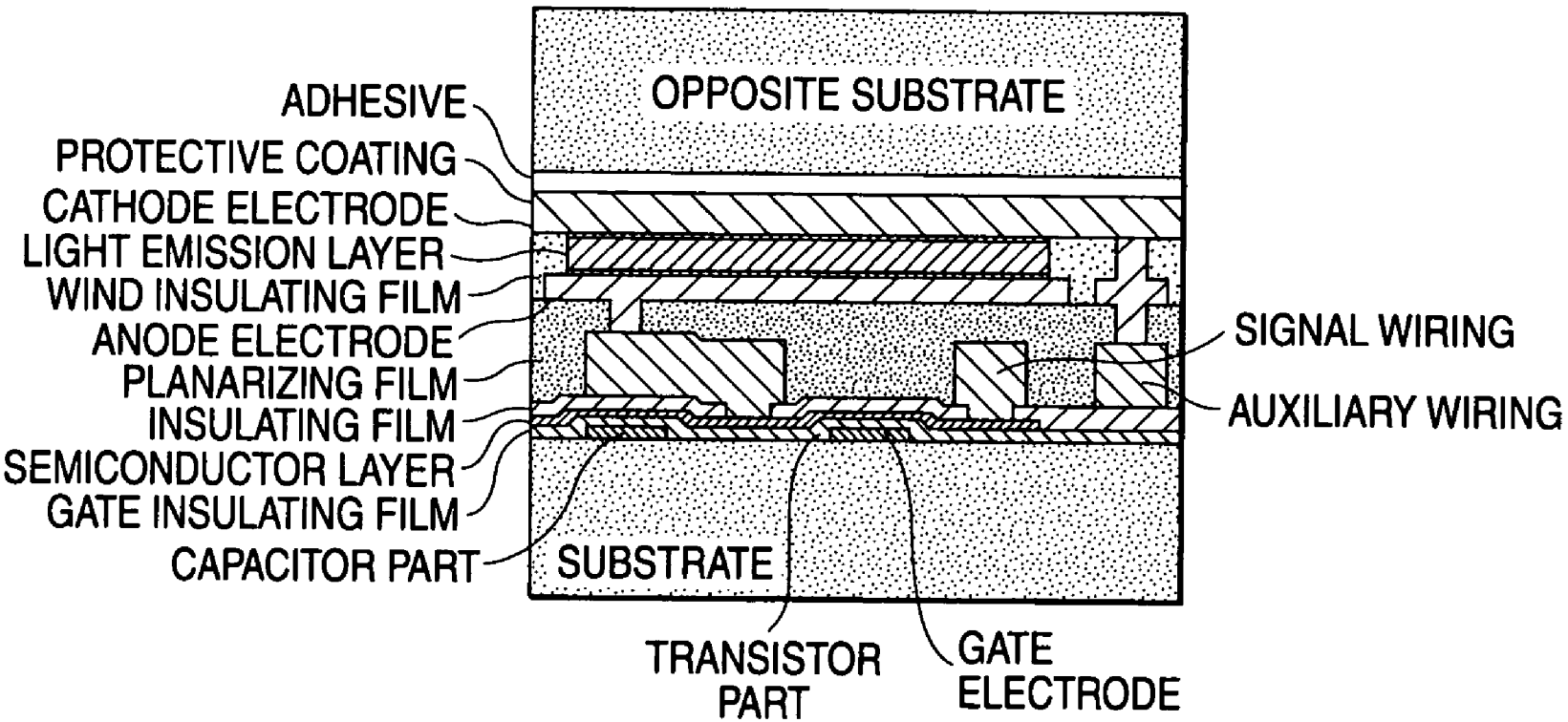
FIG. 23 is a sectional view showing a device configuration of a display device according to an embodiment of the invention.

The display device according to the embodiment of the invention has a thin film device configuration as shown in FIG. 23. The drawing shows a schematic sectional structure of a pixel formed on an insulating substrate. As illustrated, the pixel includes a transistor part containing plural thin-film transistors (one TFT is illustrated in the drawing), a capacity part such as a retention capacity, and a light emitting part of an organic EL device or the like. The transistor part and the capacity part are formed on the substrate in the TFT process, and the light emitting part of the organic EL device or the like is stacked thereon. A transparent opposing substrate is attached thereon via an adhesive to form a flat panel.

Figure 24:
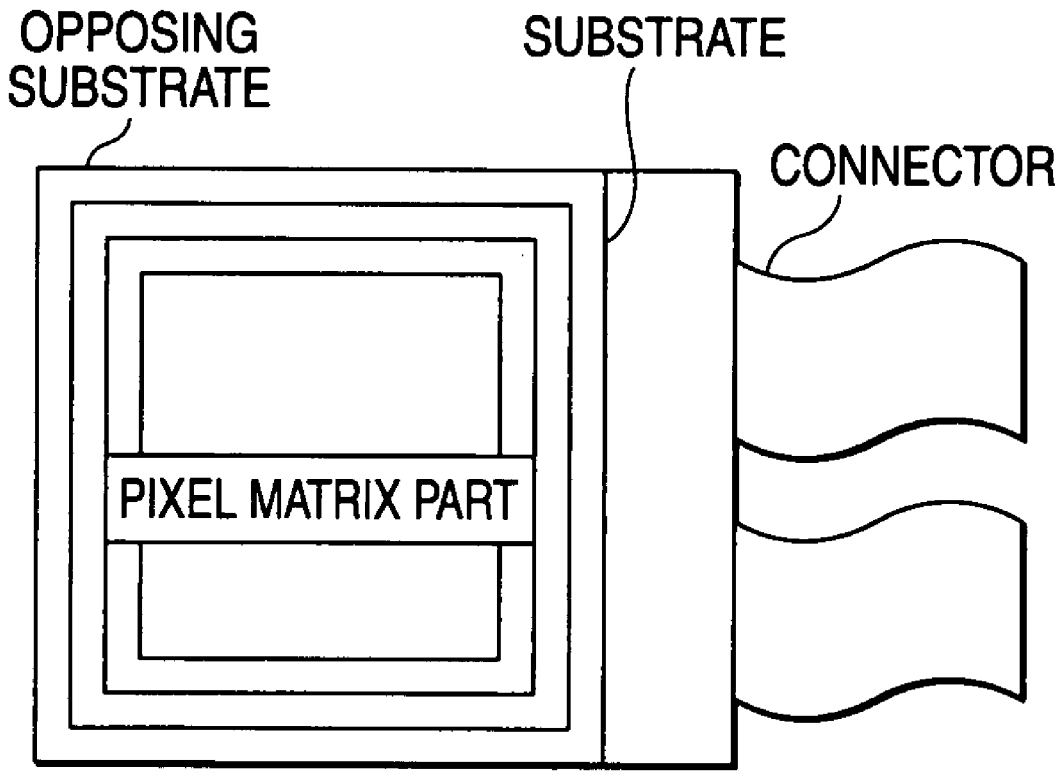
FIG. 24 is a plan view showing a module configuration of a display device according to an embodiment of the invention.

The display device according to the embodiment of the invention includes one having a flat module configuration as shown in FIG. 24. For example, on the insulating substrate, a pixel array part formed by integrating pixels each including an organic EL device, a thin-film transistor, a thin-film capacity, etc. in a matrix form is provided. Adhesives are provided surrounding the pixel array part (pixel matrix part), and an opposing substrate of glass or the like is attached to form a display module. On such a transparent opposing substrate, a color filter, protective coating, light shielding film, or the like may be provided according to need. In the display module, for example, a FPC (flexible print circuit) may be provided as a connector for external input and output of signals to the pixel array part.

The above described display device in the embodiment of the invention has a flat panel configuration, and is applicable to displays of electronic equipment in any field that displays as images or videos video signals input to or generated within various kinds of electronic equipment such as digital cameras, notebook personal computers, cellular phones, and video cameras, for example. As below, examples of electronic equipment to which the display device is applied are shown.

Figure 25:
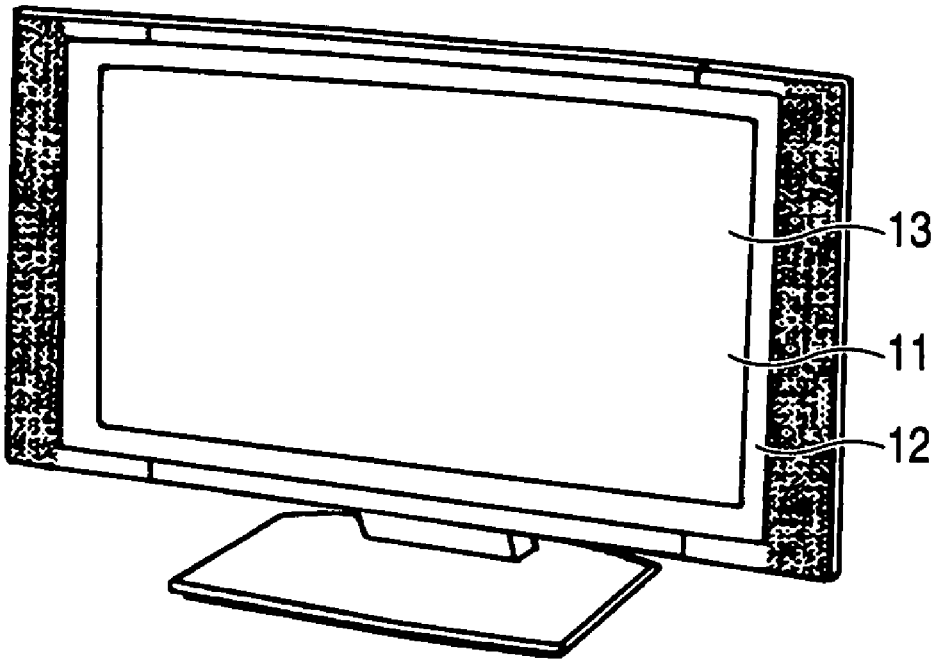
FIG. 25 is a perspective view showing a television set including a display device according to an embodiment of the invention.

FIG. 25 shows a television to which an embodiment of the invention is applied. The television includes a video display screen 11 configured by a front panel 12, a filter glass 13, etc., and is fabricated using the display device of the embodiment of the invention for the video display screen 11.

Figure 26:
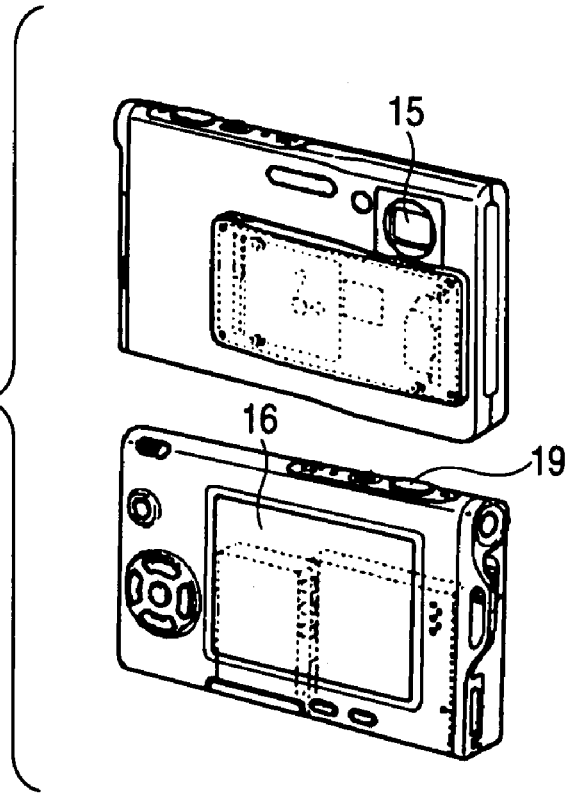
FIG. 26 is a perspective view showing a digital still camera including a display device according to an embodiment of the invention.

FIG. 26 shows a digital camera to which an embodiment of the invention is applied, and the upper drawing is a front view and the lower drawing is a rear view. The digital camera includes an imaging lens, a light emitting part 15 for flash, a display part 16, a control switch, a menu switch, a shutter 19, etc., and is fabricated using the display device of the embodiment of the invention for the display part 16 thereof.

Figure 27:
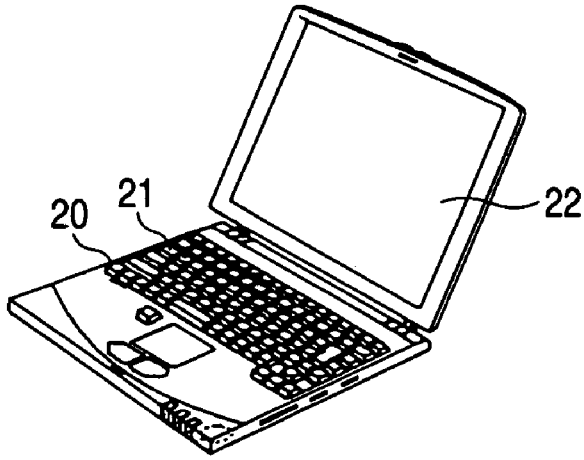
FIG. 27 is a perspective view showing a notebook personal computer including a display device according to an embodiment of the invention.

FIG. 27 shows a notebook personal computer to which an embodiment of the invention is applied. The computer includes a key board 21 to be operated when inputting characters or the like in a main body 20 and a display part 22 that displays images in a main body cover, and is fabricated using the display device of the embodiment of the invention for the display part 22 thereof.

Figure 28:
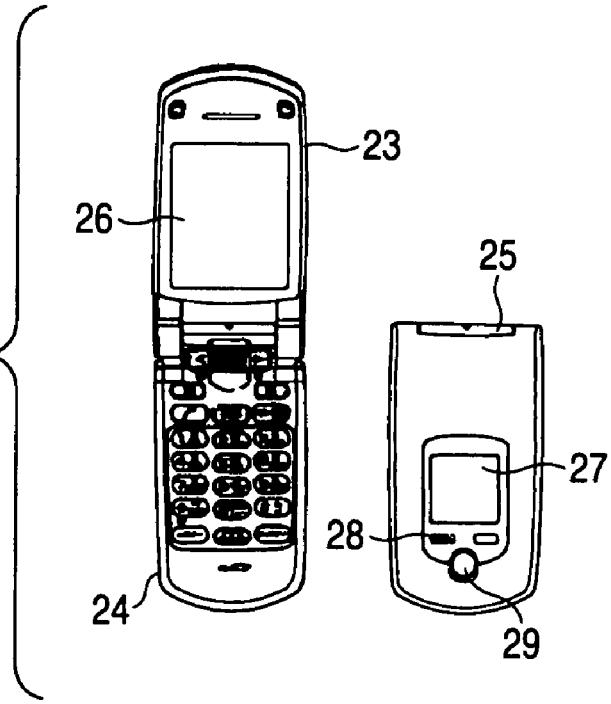
FIG. 28 is a schematic diagram showing a portable terminal device including a display device according to an embodiment of the invention.

FIG. 28 shows a portable terminal device to which an embodiment of the invention is applied, and the left drawing shows an open state and the right drawing shows a closed state. The portable terminal device includes an upper casing 23, a lower casing 24, a connecting part (here, a hinge part) 25, a display 26, a sub-display 27, a picture light 28, a camera 29, etc., and is fabricated using the display device of the embodiment of the invention for the display 26 and the sub-display 27.

Figure 29:
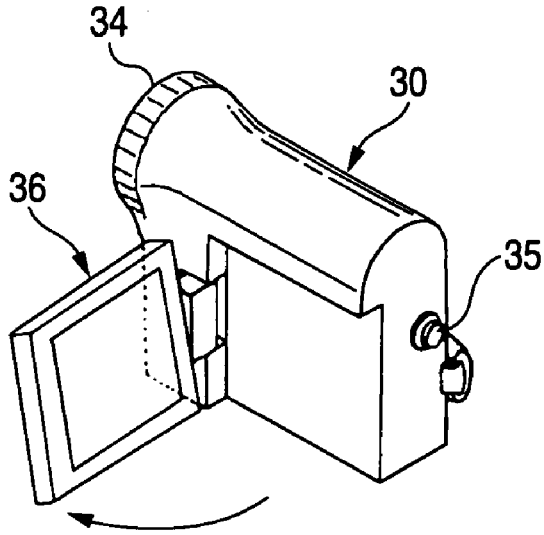
FIG. 29 is a perspective view showing a video camera including a display device according to an embodiment of the invention.

FIG. 29 shows a video camera to which an embodiment of the invention is applied. The video camera includes a main body part 30, a lens 34 for subject imaging on the side surface facing forward, a start/stop switch 35 when imaging, a monitor 36, etc., and is fabricated using the display device of the embodiment of the invention for the monitor 36 thereof.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array part; and a drive part that drives the pixel array part, the pixel array part including row-wise first scan lines and second scan lines, column-wise signal lines, pixels arranged in a matrix form on parts where the lines intersect, and power supply lines and ground lines that supply power to the respective pixels, the drive part including a first scanner that sequentially supplies first control signals to the respective first scan lines and line-sequentially scans the pixels in units of rows, a second scanner that sequentially supplies second control signals to the respective second scan lines according to the line-sequential scan, and a signal selector that supplies video signals to the column-wise signal lines according to the line-sequential scan, the pixel including a light emitting device, a sampling transistor, a drive transistor, a switching transistor, and a pixel capacity, the sampling transistor having a gate connecting to the first scan line, a source connecting to the signal line, and a drain connecting to a gate of the drive transistor, the drive transistor and the light emitting device series-connected between the power supply line and the ground line to form a current path, the switching transistor inserted into the current path and having a gate connecting to the second scan line, the pixel capacity connecting between a source and the gate of the drive transistor, wherein the sampling transistor turns on in response to the first control signal supplied from the first scan line, and samples a signal potential of the video signal supplied from the signal line and holds the potential in the pixel capacity, the switching transistor turns on in response to the second control signal supplied from the second scan line to make the current path into a conducting state, the drive transistor passes drive current to the light emitting device in response to the signal potential held in the pixel capacity through the current path in the conducting state, the drive part performs correction of mobility of the drive transistor on the signal potential held in the pixel capacity in a correction time from first timing when the second control signal is applied to the second scan line and the switching transistor turns on to second timing when the first scan signal applied to the first scan line is cancelled and the sampling transistor turns off, after applying the first control signal to the first scan line and turning on the sampling transistor to start sampling of the signal potential, at least one of the first scanner and the second scanner has output buffers for outputting the first or second control signals, the output buffer has one switching element that principally forms a rising waveform of the control signal, and another switching element that principally forms a falling waveform of the control signal, the respective switching elements are configured by transistors, respectively, in the control signal, one of the rising waveform and the falling waveform is a determining waveform that determines the first timing or the second timing in the correction time, the other of the rising waveform and the falling waveform is a non-determining waveform that is unrelated to the first timing and the second timing in the correction time, and in the output buffer, a transistor size of a superior switching element at the side of forming the determining waveform is set larger than a transistor size of an inferior switching element at the side of forming the non-determining waveform.

2. The display device according to claim 1, wherein the output buffer is an inverter including a PMOS transistor and an NMOS transistor, and, when the falling waveform of the control signal is the determining waveform, the NMOS transistor that principally forms the waveform is the superior switching element, when the rising waveform of the control signal is the determining waveform, the PMOS transistor that principally forms the waveform is the superior switching element, and the transistor size of the superior switching element is set larger than the transistor size of the inferior switching element.

3. The display device according to claim 2, wherein both determining waveforms of the first timing and the second timing are falling waveforms, and the NMOS transistors are larger than the PMOS transistors in size in both output buffers of the first scanner and the second scanner.

4. The display device according to claim 1, wherein, in the output buffer, the superior switching element includes a CMOS transistor, the inferior switching element includes an NMOS transistor or PMOS transistor, and a size of the CMOS transistor is larger than a size of the NMOS transistor or PMOS transistor.

5. The display device according to claim 1, wherein the output buffer draws a waveform of a pulse externally supplied and outputs the waveform as a determining waveform of the control signal when the superior switching element turns on and the inferior switching element turns off.

6. Electronic equipment comprising the display device according to claim 1.

7. A display device comprising:

a pixel array part; and a drive part that drives the pixel array part, the pixel array part including row-wise scan lines, column-wise signal lines, pixels arranged in a matrix form on parts where the lines intersect, and power supply lines and ground lines that supply power to the respective pixels, the drive part including a scanner that sequentially supplies control signals to the respective scan lines and line-sequentially scans the pixels, the pixel including a light emitting device, a sampling transistor, a drive transistor, a switching transistor, and a pixel capacity, the sampling transistor having a gate connecting to the scan line, a source connecting to the signal line, and a drain connecting to a gate of the drive transistor, the drive transistor and the light emitting device series-connected between the power supply line and the ground line to form a current path, the switching transistor inserted into the current path and having a gate connecting to the scan line, and the pixel capacity connecting between a source and the gate of the drive transistor, wherein at least one of the scanner has output buffers for outputting the control signals, and in the output buffer, a transistor size of a superior switching element at a side of forming a determining waveform is set larger than a transistor size of an inferior switching element at a side of forming a non-determining waveform.

* * * * *